US011845589B2

(12) United States Patent
Namba et al.

(10) Patent No.: US 11,845,589 B2
(45) Date of Patent: Dec. 19, 2023

(54) BAG BODY, FILM BODY, AND METHOD FOR MANUFACTURING BAG BODY

(71) Applicant: IDEMITSU UNITECH CO., LTD., Tokyo (JP)

(72) Inventors: Yoshinori Namba, Tokyo (JP); Ryo Katada, Tokyo (JP); Akira Otobuchi, Chonburi (TH)

(73) Assignee: IDEMITSU UNITECH CO., LTD., Tokyo (JP)

( * ) Notice: Subject to any disclaimer, the term of this patent is extended or adjusted under 35 U.S.C. 154(b) by 423 days.

(21) Appl. No.: 16/611,737

(22) PCT Filed: Apr. 26, 2018

(86) PCT No.: PCT/JP2018/016921
§ 371 (c)(1),
(2) Date: Nov. 7, 2019

(87) PCT Pub. No.: WO2018/207631
PCT Pub. Date: Nov. 15, 2018

(65) Prior Publication Data

US 2020/0407122 A1 Dec. 31, 2020

(30) Foreign Application Priority Data

May 8, 2017 (JP) ..... 2017-092532

(51) Int. Cl.
*B65D 33/25* (2006.01)
*B65D 75/66* (2006.01)
(Continued)

(52) U.S. Cl.
CPC ..... *B65D 33/2533* (2013.01); *B65D 75/66* (2013.01); *B31B 70/14* (2017.08);
(Continued)

(58) Field of Classification Search
CPC .... B65D 33/2533; B65D 75/66; B65D 31/10; B31B 70/14; B31B 70/8133; B31B 2160/10
(Continued)

(56) References Cited

U.S. PATENT DOCUMENTS 5,836,697 A * 11/1998 Chiesa ..... B65D 75/66 383/205
6,224,262 B1 * 5/2001 Hogan ..... B65D 33/2583 383/203
(Continued)

FOREIGN PATENT DOCUMENTS

CN 1148370 A 4/1997
CN 1148370 C 5/2004
(Continued)

OTHER PUBLICATIONS

Machine translation of JP 2014114035 A.*
(Continued)

*Primary Examiner* — Jes F Pascua
(74) *Attorney, Agent, or Firm* — MILLEN, WHITE, ZELANO & BRANIGAN, PC; Ryan Pool

(57) ABSTRACT

A bag includes a bag body defining a housing space, an elongated member provided on a first face portion of two face portions forming the bag body, and a tab. The elongated member includes an elongated tearing guide piece, a belt-shaped base provided between a second face portion and the tearing guide piece along a longitudinal direction of the tearing guide piece. The tab has an outer edge defined in the first face portion by a cutting line penetrating through the belt-shaped base and the first face portion. A protector covering the tab is provided on a side of the first face portion provided with the belt-shaped base.

16 Claims, 30 Drawing Sheets

(51) Int. Cl.

| | |
|---|---|
| *B31B 70/14* | (2017.01) |
| *B31B 70/81* | (2017.01) |
| *B31B 160/10* | (2017.01) |
| *B65D 30/20* | (2006.01) |

(52) U.S. Cl.
CPC ..... *B31B 70/8133* (2017.08); *B31B 2160/10* (2017.08); *B65D 31/10* (2013.01)

(58) Field of Classification Search
USPC ..... 383/205, 206
See application file for complete search history.

(56) References Cited

U.S. PATENT DOCUMENTS

| | | | | |
|---|---|---|---|---|
| 7,722,255 | B2 | 5/2010 | Tessera Chiesa | |
| 7,887,653 | B2 | 2/2011 | Goto et al. | |
| 2005/0063624 | A1 | 3/2005 | Goto et al. | |
| 2006/0104550 | A1* | 5/2006 | Kuge | B65D 75/66 383/66 |
| 2009/0050254 | A1* | 2/2009 | Goto | B31B 70/00 156/66 |
| 2009/0190867 | A1 | 7/2009 | Goto et al. | |
| 2009/0238500 | A1 | 9/2009 | Nanba et al. | |
| 2010/0014787 | A1 | 1/2010 | Katada et al. | |
| 2015/0183556 | A1* | 7/2015 | Shioda | B65D 33/2508 24/30.5 L |
| 2018/0251268 | A1 | 9/2018 | Todaka et al. | |

FOREIGN PATENT DOCUMENTS

| | | | | | |
|---|---|---|---|---|---|
| CN | 1604867 | A | | 4/2005 | |
| CN | 101014505 | A | | 8/2007 | |
| CN | 101072715 | A | | 11/2007 | |
| CN | 101522537 | A | | 9/2009 | |
| JP | 11510461 | A | | 9/1999 | |
| JP | 2002337890 | A | * | 11/2002 | |
| JP | 2003011986 | A | | 1/2003 | |
| JP | 2004276925 | A | * | 10/2004 | |
| JP | 2006298493 | A | | 11/2006 | |
| JP | 2007062829 | A | | 3/2007 | |
| JP | 2007112489 | A | | 5/2007 | |
| JP | 2013151312 | A | * | 8/2013 | |
| JP | 2014114035 | A | | 6/2014 | |
| JP | 2015123987 | A | | 7/2015 | |
| KR | 101194619 | B1 | | 10/2012 | |
| WO | 9706062 | A1 | | 2/1997 | |
| WO | 06112448 | A1 | | 10/2006 | |
| WO | WO-2016163349 | A1 | * | 10/2016 | B31B 1/90 |
| WO | 17047573 | A1 | | 3/2017 | |
| WO | WO-2017047573 | A1 | * | 3/2017 | A44B 19/16 |

OTHER PUBLICATIONS

Machine translation of WO-2016163349-A1.*
Machine translation of JP2002337890A. (Copy furnished, but not cited in PTO-892, on Sep. 16, 2022.*
Machine translation of JP-2004276925-A.*
Office Action in corresponding Chinese patent application No. 201880030125.5 dated May 25, 2021 (pp. 1-15).
International Search Report PCT/JP2018/016921 dated Jun. 19, 2018 (pp. 1-3).
Office Action issued in corresponding Chinese patent application No. 201880030125.5 dated Dec. 16, 2021 (pp. 1-13) and english translation thereof (pp. 1-16).
Office Action issued for the corresponding Korean patent application No. 10-2019-7034874 dated Nov. 22, 2022 (pp. 1-14) and english translation thereof.
Office Action in corresponding CN application 201880030125.5 dated Dec. 16, 2021 (pp. 1-13) and english translation thereof.

* cited by examiner

BAG BODY, FILM BODY, AND METHOD FOR MANUFACTURING BAG BODY

TECHNICAL FIELD

The present invention relates to a bag, a film assembly, and a manufacturing method of the bag.

BACKGROUND ART

Various bags for packaging medicine and food, which include a zipper tape bonded to a bag body made of a film, have been known. Some of these bags are provided by: back-bonding (i.e. bonding at the back) peripheries of a single film at a back side and bonding the peripheries of the film in a direction orthogonal to the back-bonding direction to form a bag body; bonding a reclosable fastener to a front wall (i.e. one of facing walls (front and back walls)) of the bag body; and attaching a pull-out plug or a thread for opening the bag at a part close to the fastener (Patent Literature 1).

In order to produce the bag according to the related art disclosed in Patent Literature 1, a film, on which the fastener is bonded in advance, is wound into a roll. While the fastener-attached film unwound from the roll is delivered to a winder, a plurality of holes for forming a pull-out plug are provided in the film using a punching mechanism and the fastener is bonded to the film. Then, both sides of the film are folded to be overlapped and the overlapped portion is back-bonded. After a lower end of the film is bonded and the contents are packed, upper end of the film is bonded.

CITATION LIST

Patent Literature(S)

Patent Literature 1: JP 11-510461 A

SUMMARY OF THE INVENTION

Problems to be Solved by the Invention

In the typical arrangement according to Patent Literature 1, a plurality of holes are provided to a front wall using a punching mechanism to form a pull-out plug. These holes bring an inside of the bag body into communication with an outside of the bag body, so that sealability of the bag may become insufficient.

It is also disclosed in the typical arrangement according to Patent Literature 1 that a thread for unsealing the bag is provided on an inner side of the front wall. However, no specific process for exposing an end of the thread to an outside to form a tab is disclosed. In order for an end of the thread to serve as a tab, a hole that allows the thread to penetrate through the film of the bag may be formed in the front wall. However, such a hole brings an inside of the bag in communication with an outside of the bag, possibly failing to provide sufficient sealability.

An object of the invention is to provide a bag and a film assembly capable of providing high sealability, and a manufacturing method of the bag.

Means for Solving the Problems

A bag according to an aspect of the invention includes: a bag body made of at least one film, the bag body including a plurality of face portions provided by folding or overlapping the film and including mutually facing first face portion and second face portion, the face portions defining a housing space; an elongated member provided on the first face portion; and a tab, the elongated member including an elongated tearing guide piece, and a belt-shaped base interposed between the second face portion facing the first face portion and the tearing guide piece along a longitudinal direction of the tearing guide piece, the tab being provided on the first face portion to allow the tearing guide piece to be pinched, the tab including an outer edge defined by a cutting line penetrating through the belt-shaped base and the first face portion, where a protector covering the tab is provided on a surface of the first face portion provided with the belt-shaped base. A cutting area configured to cut the belt-shaped base in a manner intersecting a width direction of the tearing guide piece may be provided adjacent to both ends of the cutting line.

In the bag according to the above aspect of the invention with contents being housed in its housing space and its periphery being sealed, when the tab is pulled in a direction away from the second face portion in order to unseal the bag, the tearing guide piece rips the first face portion to form an opening along a longitudinal direction of the tearing guide piece. The contents housed in the housing space can be taken out of the opening.

The bag according to the above aspect of the invention has the protector for covering the tab, whose outer edge is defined by the cutting line, on the surface of the first face portion provided with the belt-shaped base. Accordingly, after the contents are packed in the housing space and before the bag is unsealed, the housing space is kept from being in communication with an exterior space of the bag through the cutting line, providing excellent sealability.

The tearing guide piece herein refers to a member bonded to the first face portion of the film of the bag body to assist unsealing of the bag body by guiding the ripping of the first face portion of the film along the bonding position of the tearing guide piece on the first face portion of the film.

The tearing guide piece may be directly bonded to the first face portion or may be indirectly provided to the first face portion through a member (e.g. the belt-shaped sheet).

The belt-shaped base may be made of a single member or may be made of a plurality of members arranged along the longitudinal direction of the tearing guide piece.

The shape of the cutting line is not particularly limited as long as the cutting line is capable of defining the outer edge of the tab sufficient to hold the tearing guide piece in order to guide the ripping of the film of the bag body. For instance, the cutting line may have a C-shaped profile, a semicircular profile, a polygonal profile or the like so that the tearing guide piece is sandwiched by the ends of the cutting line at a point in the longitudinal direction.

The shape of the cutting area is not particularly limited as long as the cutting area is capable of cutting the belt-shaped base and exposing the tearing guide piece through the cutting area. For instance, the cutting area may be linear or curved.

The cutting area configured to cut the belt-shaped base in a manner intersecting a width direction of the tearing guide piece, which is provided adjacent to both ends of the cutting line of the tab, reduces resistance applied to the tab when the bag is unsealed. Specifically, when the cutting line defining the outer edge of the tab is located away from the cutting area in the belt-shaped base, in pulling the tab away from the second face portion, the belt-shaped base is ripped along the longitudinal direction of the tearing guide piece from the peripheral end of the cutting line, causing resistance. However, when the cutting area is provided adjacent to both ends of the cutting line of the belt-shaped base, the belt-shaped base is no more ripped after the belt-shaped base is cut at the cutting area, thereby reducing the resistance.

In order to form the cutting area and the tab, for instance, an elongated member including the belt-shaped base and the tearing guide piece may be bonded to the first face portion of the film in advance. Then, a cutting unit including a penetration blade configured to penetrate through the elongated member and the film and a cutting blade whose cutting depth is adjusted so that only the belt-shaped base is cut at the bonded part of the tearing guide piece and the belt-shaped base without penetrating through the tearing guide piece may be used to push the blades into the elongated member and the film from the belt-shaped base, thereby simultaneously forming the cutting line and the cutting area. In this case, the cutting line and the cutting area are preferably adjacent to each other. The term "adjacent to" herein means that the cutting line and the cutting area are directly connected or are provided with a small gap therebetween. Even when a gap is present between the cutting line and the cutting area, the cutting line and the cutting area are substantively adjacent to each other if the bag formed with the gap can be easily torn in holding the tab to unseal the bag.

The belt-shaped base and the tearing guide piece may be integrated or may be independent components.

When the belt-shaped base and the tearing guide piece are integrated, for instance, a resin for the belt-shaped base and a resin for the tearing guide piece are preferably co-extruded to form the integrated belt-shaped base and the tearing guide piece.

The material and shape of the protector are not particularly limited as long as the protector is capable of covering the tab to keep the housing space of the bag from being in communication with an exterior space of the bag through the cutting line defining the outer edge of the tab. For instance, the protector may be made of the same material as the belt-shaped base or made of different materials. The shape of the protector may be rectangular, circular, or triangular.

The protector is configured to cover the tab and is bonded to the first face portion so that the housing space of the bag is kept from being in communication with the exterior space of the bag through the cutting line defining the outer edge of the tab. The surface of the protector facing the first face portion is not entirely bonded to the first face portion. The protector is bonded to the first face portion in any manner as long as the protector can cover the tab so that the housing space of the bag is kept from being in communication with the exterior space of the bag through the cutting line defining the outer edge of the tab. For instance, the protector may be bonded to the first face portion at an outer periphery of the part covering the tab. Further, the protector, which may be provided only at a part covering the tab, may run the entire length of the belt-shaped base along the longitudinal direction of the belt-shaped base.

The specific structure for bonding the protector to the film and the like is not particularly limited as long as the protector is capable of covering the tab to keep the housing space of the bag from being in communication with the exterior space of the bag through the cutting line. For instance, the periphery of the protector may be bonded to the film and the belt-shaped base to cover the tab. The protector is suitably bonded to the film and the like through a known process using heat-sealing, ultrasonic sealing, adhesive, or the like.

After the cutting area is provided, since the protector is configured to cover the tab and the cutting area provided at a position adjacent to both ends of the cutting line of the tab, when the tab is pinched to start ripping the first face portion of the film with the tearing guide piece, the protector covering the belt-shaped base and the tab is not torn, due to the presence of the cutting area. Accordingly, the protector is kept from being pulled in unsealing the bag to disturb the ripping of the first face portion of the film. Thus, the protector is kept from being pulled in unsealing the bag to disturb the ripping of the first face portion of the film.

The bag body, which has only mutually facing two face portions, may alternatively have two or more face portions such as a gusset bag including a facing pair of face portions, a pair of lateral face portions interposed between the face portions at peripheral edges of the pair of face portions, and a bottom face portion, the lateral face portions and the bottom face portion being interfolded inward along a bend line.

In the gusset bag, the tearing guide piece and the belt-shaped base are provided on the first face portion of the pair of face portions. Both ends of the tearing guide piece and the belt-shaped base may reach or may not reach the interfolded part of the lateral face portions.

In the above aspect of the invention, the bag body is made of at least one film. For instance, mutually opposite edges of a single film are folded at a position remote from the edges, and the overlapped portions of the folded edges may be bonded through back-bonding, butt-seaming or the like. Alternatively, mutually opposite edges of a single film may be two-folded at a position remote from the edges by the same distance, and the overlapped peripheries of the two-folded edges may be bonded. Further, two films may be mutually overlapped and mutually opposite edges o the two films may be each bonded. Alternatively, the pair of face portions and the pair of lateral face portions may be provided using four films, and another film may be used to form the bottom face portion to make a gusset bag.

The tearing guide piece and the belt-shaped base are provided on the first face portion of the pair of face portions and not on the second face portion of the pair of face portions. Thus, a gap for packing the contents in the housing space can be formed between the tearing guide piece/the belt-shaped base and the second face portion. The bag housing the contents can be thus produced by packing the contents in the housing space through the gap and subsequently bonding the bag body to close the gap.

In order to manufacture the bag, the tearing guide piece and the belt-shaped base are fed to a surface of the film along the longitudinal direction thereof to provide the tearing guide piece and the belt-shaped base on the film. Further, the outer edge of the tab is defined by the cutting line penetrating through the film and the belt-shaped base. In addition, the cutting area is provided at a position adjacent to the both ends of the cutting line of the tab and the protector covering the tab is provided on the surface of the film provided with the belt-shaped base.

A cut portion for cutting the tearing guide piece and the first face portion may be provided in the tearing guide piece and the first face portion at a position different from the tab. When the lateral sides or the like of the bag are sealed, the cut portion may be provided in the sealed portion.

The cut portion for cutting the tearing guide piece and the first face portion may be provided in the tearing guide piece and the first face portion at a position different from the tab. Further, the cut portion may be sealed. The cut portion may be provided at a portion independent of the sealed portion.

Since the cut portion provides a terminal for the part to be ripped by the tearing guide piece, the first face portion is kept from being torn by the tearing guide piece more than necessary, thereby controlling the location of the opening of the bag.

A bag according to another aspect of the invention includes: a bag body made of at least one folded or overlapped film, the bag body including a plurality of face portions including mutually facing first face portion and second face portion, the face portions defining a housing space; an elongated member provided on the first face portion; and a tab, the elongated member including an elongated tearing guide piece and a zipper tape, the zipper tape including a first member including a belt-shaped base and a first engagement portion continuous with the belt-shaped base and a second member including a belt-shaped body and a second engagement portion continuous with the belt-shaped body and engageable with the first engagement portion, where: the belt-shaped base is extended in a width direction to protrude beyond a first end of the belt-shaped body in the width direction when the first engagement portion and the second engagement portion are engaged; an extended part of the belt-shaped base and the belt-shaped body are bonded to the first face portion with a surface provided with the first engagement portion and a surface not provided with the second engagement portion, respectively; the belt-shaped base is interposed between the second face portion facing the first face portion and tearing guide piece along the longitudinal direction of the tearing guide piece; the tab allows the tearing guide piece to be pinched and includes an outer edge defined by a cutting line penetrating through the belt-shaped base and the first face portion; and a protector covering the tab is provided on a surface of the first face portion provided with the belt-shaped base. A cutting area configured to cut the belt-shaped base in a manner intersecting a width direction of the tearing guide piece may be provided adjacent to both ends of the cutting line.

According to the above aspect of the invention, when the tab is pulled in a direction away from the second face portion in order to unseal the bag, the tearing guide piece rips the first face portion to form an opening along a longitudinal direction of the tearing guide piece. The first engagement portion and the second engagement portion of the zipper tape are exposed through the opening. After the first engagement and second engagement portions of the zipper tape are disengaged, the contents housed in the housing space can be taken out. After the contents are taken out, the first engagement portion and the second engagement portion are engaged to close the bag.

According to the above aspect of the invention, the first engagement portion and the second engagement portion are bonded to the bag body while being engaged. Further, the protector for covering the tab, whose outer edge is defined by the cutting line, is provided on a surface of the first face portion provided with the belt-shaped base. Accordingly, before the bag is unsealed, the housing space is kept from being in communication with the exterior space through the cutting line, maintaining excellent sealability.

Since the belt-shaped base and the belt-shaped body of the zipper tape are bonded to the first face portion, the contents can be packed in the bag without releasing the engagement between the first engagement portion and the second engagement portion. Accordingly, the contents can be easily packed in the bag.

Herein, the first engagement portion and the second engagement portion may be mutually engaging male and female portions, or may be a mutually engaging pair of hook-shaped portions. Further, a plurality of pairs of the first engagement portion and the second engagement portion may be provided. In this case, all of the plurality of pairs of the first engagement portion and the second engagement portion may consist of pairs of the male and female portions or pairs of two hook-shaped portions, or may include pair(s) of the male and female portions and pair(s) of mutually engaging two hook-shaped portions in combination.

When the first engagement portion and the second engagement portion are provided by a combination of the pair(s) of the male and female portions and pair(s) of the two hook-shaped portions, one of the two hook-shaped portions may be continuous with the belt-shaped base and face an extended part of the belt-shaped base and the other of the hook-shaped portions may face opposite the one of the two hook-shaped portions. When the extended part of the belt-shaped base and the belt-shaped body are pulled in opposite directions while the male and female portions are engaged, a force (shear force) acts in a direction for separating the belt-shaped base and the belt-shaped body within a plane. Thus, the one and the other of the hook-shaped portions are mutually strongly engaged in proportion to a pulling force, providing strong engagement in addition to the engagement between the male and female portions. In contrast, when the extended part of the belt-shaped base and the part of the belt-shaped body facing the extended part are pulled in a direction mutually away from each other, the male and female portions and the hook-shaped portions are disengaged.

The tearing guide piece may be directly bonded to the first face portion or may be indirectly provided to the first face portion through the belt-shaped body.

In the bag according to the above aspects of the invention, the belt-shaped base and the tearing guide piece may be integrated.

The phrase "the belt-shaped base and the tearing guide piece are integrated" herein refers to an arrangement in which the belt-shaped base and the tearing guide piece are integrated through extrusion molding, an arrangement in which the belt-shaped base and the tearing guide piece are separately produced and are later bonded to be integrated, and the like.

The bag according to the above aspect of the invention may include a cut portion formed at a position different from the tab in the tearing guide piece and the first face portion, the cut portion being configured to cut the first face portion and the tearing guide piece in a manner intersecting the width direction of the tearing guide piece.

According to the above arrangement, upon pinching the tab and pulling the tearing guide piece to open the bag, when an unsealed part of the bag reaches the cut portion, at which the first face portion and the tearing guide piece are cut, the first face portion is not ripped beyond the cut portion. In other words, since the cut portion provides a terminal for the part to be ripped by the tearing guide piece, the first face portion is kept from being torn by the tearing guide piece more than necessary, thereby controlling the location of the opening of the bag. Further, the cut portion only cuts the first face portion and the tearing guide piece and does not cut the belt-shaped base provided along the longitudinal direction of the tearing guide piece. Accordingly, the housing space of the bag body is kept from being in communication with the exterior space through the cut portion before the bag body is unsealed.

The cut portion may be sealed. In order to seal the cut portion, pressure may be applied to the belt-shaped base from an inside and outside of the first face portion.

In the bag according to the above aspect of the invention, the bag body may be made of a single film, the bag body being provided with a bonding portion formed by overlapping edges of the film located opposite with each other.

According to the above arrangement, the edges of the film are back-bonded to form the bonding portion.

The bonding portion for the back-bonding may be provided through butt-seaming (bonding the same face of the film) or may be provided through "envelope-seaming" (i.e. bonding different faces of the film).

In the bag according to the above aspect of the invention, the plurality of face portions may include a pair of face portions facing each other and a bottom face portion bonded with the pair of face portions at peripheral ends thereof.

According to the above arrangement, the presence of the bottom face portion allows the bag to stand upright with the contents being housed in the housing space. Thus, the bag can be displayed upright on a store shelf in retail shops and the like. Further, when the bag is provided with the zipper tape, with the first and second engagement portions being released to open the bag, the bag is not likely to tumble over, so that the contents do not leak out from the bag.

In the bag according to the above aspect of the invention, the plurality of face portions may include a pair of face portions facing each other, a pair of lateral face portions provided at side edges of the pair of face portions and facing each other through the pair of face portions, and the bottom face portion, and the lateral face portions may be each interfolded along a bend line.

According to the above arrangement, the bag body in a form of a gusset bag allows the bag to stand upright with the contents being housed in the housing space, so that the bag can be displayed upright on a store shelf in retail shops and the like.

In the bag according to the above aspects of the invention, a grip may be provided in the bag body.

According to the above arrangement, the grip allows the bag to be easily held.

The configuration of the grip is not particularly limited as long as the grip can be held by hand. For instance, the grip may be suitably provided by: one or more hole-shaped grip provided to an upper end; a string inserted through the upper end of the bag body; a grip member made of resin, metal or the like bonded to the upper end of the bag; or the like.

A film assembly according to still another aspect of the invention includes: a film; a plurality of elongated members provided on one surface of the film and mutually spaced apart in a direction of the film; and a tab, where the elongated members each includes: an elongated tearing guide piece; and a belt-shaped base provided on a surface of the tearing guide piece opposite a surface of the tearing guide piece facing the film, the belt-shaped base extending along a longitudinal direction of the tearing guide piece, the tab includes an outer edge defined by a cutting line penetrating through the belt-shaped base and the film, the tab allowing the tearing guide piece to be pinched, a protector covering the tab is provided on a surface of the film provided with the belt-shaped base, and a length of the film in a width direction is more than twice as large as a length of each of the elongated members in a longitudinal direction. A cutting area configured to cut the belt-shaped base in a manner intersecting a width direction of the tearing guide piece may be provided adjacent to both ends of the cutting line.

According to the above aspect of the invention, the bag is producible by bonding the peripheral ends of the film of the film assembly to turn the film into a tube, and bonding a part of the film corresponding to the bottom portion of the bag. In manufacturing the bag, an existing machine for bonding the part corresponding to the bottom portion can be used, so that the bag can be easily manufactured.

Since the width of the film along the first direction of the film is more than twice as large as the length of the elongated member in the longitudinal direction, the film can be reliably overlapped when the peripheral ends of the film are folded inward from both ends of the elongated member. Accordingly, the film can be turned into a tube by bonding the overlapped portion and linearly forming the bonding portion.

Further, after folding the film of the film assembly along a circumference of a cylindrical member to turn the film into a tube and bonding the portion corresponding to the bottom portion of the bag, the contents are packed in the bag through the cylindrical member and a portion corresponding to the top portion of the bag is bonded, thereby easily manufacturing the bag housing the contents.

Further, since a plurality of elongated members are provided on the film, the film assembly can be easily transferred by winding the film into a roll or folding the film.

The bottom portion, which herein refers to a portion of the manufactured bag provided opposite the top portion and bonded to keep the contents from being leaked, is linearly formed by bonding a mutually facing pair of face portions of the film. A bottom face portion is sometimes provided to the bottom portion in order to allow the bag to stand upright. The bottom face portion may be formed using a second film independent of the film turned into a tube. In this case, the bottom face portion is bonded to the pair of face portions at peripheral ends thereof.

A film assembly according to a further aspect of the invention includes: a film; a plurality of elongated members provided on one surface of the film in a manner mutually spaced apart in a direction of the film; and a tab, where the elongated members each include: an elongated tearing guide piece; and a zipper tape, the zipper tape includes: a first member including a belt-shaped base and a first engagement portion continuous with the belt-shaped base; and a second member including a belt-shaped body and a second engagement portion continuous with the belt-shaped body and engageable with the first engagement portion, the belt-shaped base is extended in a width direction to protrude beyond a first end of the belt-shaped body in the width direction when the first engagement portion and the second engagement portion are engaged, the extended part of the belt-shaped base and the belt-shaped body are bonded to the film with a surface provided with the first engagement portion and a surface not provided with the second engagement portion, respectively, the belt-shaped base is provided on a surface of the tearing guide piece opposite a surface of the tearing guide piece facing the film, the tab includes an outer edge defined by a cutting line penetrating through the belt-shaped base and the film, the tab allowing the tearing guide piece to be pinched, a protector covering the tab is provided on a side of the film provided with the belt-shaped base, and a length of the film in a width direction is more than twice as large as a length of each of the elongated members in a longitudinal direction. A cutting area configured to cut the belt-shaped base in a manner intersecting a width direction of the tearing guide piece may be provided adjacent to both ends of the cutting line.

According to the above aspect of the invention, peripheral ends of the film are folded toward the inner side of the film provided with the elongated member and the overlapped portion is bonded to form the linear bonding portion, thereby turning the film into a tube. The folded part and the unfolded part of the film are bonded along the transverse direction intersecting the bonding portion to form the bottom portion of the bag. Then, the film is cut at the position opposite the part bonded along the transverse direction of the film across the elongated member.

Accordingly, the bag provided with the zipper tape can be manufactured through the above series of steps in the above aspect of the invention.

The film assembly according to the above aspect of the invention may include a cut portion formed at a position different from the tab in the tearing guide piece and the film, the cut portion being configured to cut the film and the tearing guide piece in a manner intersecting the width direction of the tearing guide piece.

According to the above arrangement, when the tab is pulled, the tearing guide piece rips the film to form an opening along a longitudinal direction of the tearing guide piece. When the pulled tearing guide piece reaches the cut portion, since the film and the tearing guide piece are cut at the cut portion, the film is not ripped beyond the cut portion.

Accordingly, the film assembly can be used in manufacturing the bag having the cut portion as a terminal for the portion to be ripped by the tearing guide piece.

The film assembly according to the above aspect of the invention may include at least two second films, one of peripheral ends of each of the second films being bonded with the film in parallel to the elongated members to form the bottom face portion.

According to the above arrangement, the elongated member is provided on a surface of the film, and the cutting line penetrating through the belt-shaped base and the film is provided to form the outer edge of the cutting area for cutting the belt-shaped base. Then, the tab is covered with the protector. Further, a peripheral end of the second film is bonded to the film in parallel to the elongated member to produce the film assembly. A plurality of the elongated members and corresponding number of plurality of the second film are provided on a single film.

With the thus produced film assembly, the bag having the bottom face portion can be manufactured by bonding the other peripheral end of the second film to the folded part of the film when a part of the film intersecting the overlapped portion provided by inwardly folding the peripheral ends of the film is bonded.

The film forms the pair of face portions of the bag body. The second film forms the bottom face portion with mutually opposite peripheral ends being located on the pair of face portions of the bag body. Though the shape of the second film is not particularly limited, the second film is, for instance, rectangular. In order to bond the film with the other peripheral end of the second film, the second film may be folded in advance.

A manufacturing method of a bag according to still further aspect of the invention includes: feeding the film assembly according to the above aspect of the invention; folding peripheral ends of the film along a feeding direction of the film toward an inner side provided with the elongated members and bonding an overlapped portion to form a linear bonding portion, thereby turning the film into a tube; bonding a folded part and an unfolded part of the film along a transverse direction intersecting the bonding portion to form a bottom portion of the bag; and cutting the film in parallel to the bottom portion at a position opposite the part bonded along the transverse direction of the film across the elongated member.

According to the above aspect of the invention, in feeding the film assembly, the film assembly is delivered in a direction along which the elongated members are arranged. In turning the film into a tube, the side edges of the film of the film assembly are folded inward and overlapped portions are bonded to form a linear bonding portion. In forming the bottom portion of the bag, the folded part and the unfolded part of the film are bonded along the transverse direction intersecting the bonding portion to form the bottom portion of the bag. Then, the film is cut at the bonded portion at an opposite position across the elongated member.

Thus, the bag before the contents are packed can be manufactured. The contents are then put into the housing space of the bag body through a cut opening formed in the process of cutting the film. Subsequently, the films are bonded along the cut opening at a part near the cut opening.

According to the above aspect of the invention, the above steps are performed while feeding the film assembly, so that a plurality of bags can be continuously manufactured.

A known process using heat-sealing, ultrasonic sealing, adhesive, or the like is suitably used in bonding the film. In applying the heat-sealing or ultrasonic sealing, a sealer such as a seal bar is used.

In cutting the film, a cutter or the like is used.

A manufacturing method of a bag according to still further aspect of the invention includes: feeding the film assembly according to the above aspect of the invention; folding peripheral ends of the film along a feeding direction of the film toward an inner side provided with the elongated members and bonding an overlapped portion to form a linear bonding portion, thereby turning the film into a tube; bonding the film and the other of the peripheral ends of the plurality of additional films along a transverse direction intersecting the bonding portion to form a bottom portion of the bag; and cutting the film in parallel to the bottom portion at a position opposite the part bonded along the transverse direction of the film across the elongated member.

According to the above aspect of the invention, the bag having the bottom face portion can be easily manufactured by bonding a part of the film intersecting the overlapped portion provided by inwardly folding the peripheral ends of the film and bonding the peripheral end of the second film to the folded part of the film.

In order to provide a self-standing bag, it is preferable that a part of the second film that is bonded to the film in advance and a part opposite the bonded part are orthogonal to the film-overlapped portion.

The step for turning the film into a tube and the step for bonding the second film to the folded part of the film may be simultaneously conducted or may be conducted with a time lag.

The manufacturing method of a bag according to the above aspect of the invention may further includes: after forming the bottom portion, packing contents in an inside of the film, which has been turned into the tubular film; and after the contents are packed in the inside of the film, bonding a folded part and an unfolded part of the film at a position remote from the bottom portion along the bonding portion to form a top portion of the bag, where, in cutting the film, after forming the top portion, the film is cut at the top portion of the bag or a part of the top portion located opposite a side packed with the contents.

According to the above arrangement, after forming the bottom portion, the contents are packed in the film, which has been turned into the tubular film. Since the elongated member, which is provided on one surface of the film, is spaced by a gap from the folded part, the contents can be put into the interior of the film through the gap. The top portion of the bag is formed after the contents are packed in the bag. Accordingly, the contents are kept from being leaked out of the tubular film. After the top portion is formed, a part of the bag corresponding to the top portion is cut, thereby manufacturing the bag packed with the contents.

According to the above aspect of the invention, the above steps are performed while the film assembly including a plurality of elongated members provided on the film is fed in the direction orthogonal to the longitudinal direction of the elongated member.

In order to manufacture the first bag including one of the elongated members located at a leading edge in the feeding direction of the film assembly, the folded and unfolded parts of the film are bonded to form the bottom portion of the bag, and the contents are packed in the tubular film provided with the bottom portion. Subsequently, the folded and unfolded parts of the film are bonded to form the top portion of the bag. Then, in order to produce the second bag including the elongated member located next to the elongated member at the leading edge, the bottom portion of the bag is formed, the contents are packed in the tubular film, and the top portion of the bag is formed, as in the first bag. It should be noted that the terms "first" and "second" herein are used for the convenience of description. When a certain bag is referred to as the first bag, the bag produced next will be referred to as the second bag. In other words, the elongated member at an end of the film is not necessarily the "first."

It should be noted that the top portion of the first bag and the bottom portion of the second bag may be simultaneously formed. Alternatively, the top portion of the first bag may be formed after the bottom portion of the second bag is formed.

When the bottom face portion for a self-standing bag is provided to the bag, a thickness of a film-overlapped portion corresponding to the bottom face portion is different from a thickness of a film-overlapped portion corresponding to the top portion. Specifically, in order to form the bottom face portion, the second film independent of the tubular film is two-folded and the folded and aligned peripheral ends are bonded to the inner circumferential surface of the tubular film. In this case, total four layers of the films are overlapped at the portion forming the bottom face portion (i.e. two layers of the overlapped tubular film plus two layers of the overlapped two-folded second film). In contrast, when the bottom face portion for self-standing bag is not provided to the bag and the bottom portion is formed from the tubular film, the portion for forming the bottom portion, which is provided by bonding mutually facing parts of the tubular film, has a thickness corresponding to two layers of the film. Meanwhile, the top portion, which is formed by bonding mutually facing parts of the tubular film, has a thickness corresponding to two layers of the film irrespective of the presence of the bottom face portion. Accordingly, when the bottom face portion is provided to the bag, the portion corresponding to the bottom face portion has thick film-overlapped portion provided by the film and the second film, while the portion corresponding to the top portion has thin film-overlapped portion due to the absence of the second film. In contrast, when the bottom portion is not provided to the bag, the thickness of the film-overlapped portion is the same in both of the portion corresponding to the bottom portion and the portion corresponding to the top portion.

Accordingly, the structure for forming the bottom portion and the top portion is changed depending on the thickness of the film-overlapped portion.

When the bag without the bottom face portion is continuously manufactured, since the thickness of the film-overlapped portion corresponding to the top portion of the first bag is the same as the thickness of the film-overlapped portion corresponding to the bottom portion of the second bag, the film-overlapped portion is bonded with a single seal bar, and the middle part of the bonded region is cut to manufacture the bag.

When the bag having the bottom face portion is continuously manufactured, since the thickness of the film-overlapped portion corresponding to the top portion of the first bag is thicker than the thickness of the film-overlapped portion corresponding to the bottom portion of the second bag, a seal bar for forming the top portion and a seal bar for forming the bottom portion are separately prepared, and the middle part of the region bonded by these seal bars is cut to manufacture the bag.

A manufacturing method of a bag according to still further aspect of the invention includes: feeding an elongated member onto a film along a longitudinal direction of the elongated member, the elongated member including an elongated tearing guide piece and a belt-shaped base provided along the longitudinal direction of the tearing guide piece, the film having a length in the width direction more than twice as large as a length of the elongated member in the longitudinal direction, the elongated member being fed so that the tearing guide piece faces the film and the belt-shaped base faces opposite the film; providing the elongated member on a surface of the film; forming on a surface of the film a tab that allows the tearing guide piece to be pinched; covering the tab on the surface of the film with a protector; folding peripheral ends of the film toward an inner side provided with the elongated member and bonding an overlapped portion to form a linear bonding portion, thereby turning the film into a tubular film; bonding a folded part and an unfolded part of the film along a transverse direction intersecting the bonding portion to form a bottom portion of the bag; packing contents in an inside of the tubular film; after the contents are packed in the inside of the film, bonding a folded part and an unfolded part of the film at a position remote from the bottom portion along the bonding portion to form a top portion of the bag; and cutting the film at the top portion of the bag or a part of the top portion located opposite a side packed with the contents, where, in providing the tab, a cutting line penetrating through the belt-shaped base and the film is provided to form an outer edge of the tab, a cutting area configured to cut the belt-shaped base in a manner intersecting a width direction of the tearing guide piece is provided at a position adjacent to both ends of the cutting line, and, in covering the tab with the protector, the protector is bonded to the surface of the film.

In the above aspect of the invention, the units for performing the respective steps are installed in respective stages at a predetermined distance, and the film is fed so that these units are sequentially operable, thereby manufacturing the bag.

Initially, the step for providing the elongated member to the film is performed. Accordingly, the elongated member including the tearing guide piece and the belt-shaped base is formed in advance and the elongated member is fed onto a surface of the film so that the tearing guide piece of the elongated member faces the film and the belt-shaped base faces opposite the film, thereby providing the elongated member on the film. In order to provide the elongated member on the film, for instance, a seal bar may be used.

Then, a step for feeding the film and moving the elongated member provided on the film to the next stage to provide the tab is performed. Initially, the cutting line penetrating through the belt-shaped base and the film is provided to form the outer edge of the cutting area for cutting the belt-shaped base. In this step, the cutting line may be provided using a penetration blade and the cutting area may be provided using a cutting blade. The step for forming the outer edge defined by the cutting line may be performed before, after, or simultaneously with the step for forming the cutting area.

Then, the film is fed and the elongated member provided with the tab is moved to the next stage. Initially, the tab is covered with the protector. Specifically, the protector is disposed on the tab and, subsequently, the protector is bonded to the film and the like.

Further, the film provided with the elongated member is delivered, the bonding portion is formed, the bottom portion of the bag is formed along the transverse direction intersecting the bonding portion, the contents are packed in the bag, and then the top portion of the bag is formed.

A manufacturing method of a bag according to still further aspect of the invention includes: feeding an elongated member on a film, the elongated member including an elongated zipper tape and an elongated tearing guide piece, the zipper including a first member including a belt-shaped base and a first engagement portion continuous with the belt-shaped base and a second member including a belt-shaped body and a second engagement portion continuous with the belt-shaped body and engageable with the first engagement portion, the belt-shaped base being extended in a width direction beyond a first end of the belt-shaped body in the width direction when the first engagement portion and the second engagement portion are engaged, the tearing guide piece being provided on a surface of the belt-shaped base provided with the first engagement portion along a longitudinal direction of the belt-shaped base, the film having a length in a width direction that is more than twice as large as a length of the elongated member in the longitudinal direction, the elongated member being fed in the longitudinal direction so that the tearing guide piece faces the film and the belt-shaped base faces opposite the film; providing on the film a tab that allows the tearing guide piece to be pinched; covering the tab on the surface of the film with a protector; folding peripheral ends of the film toward an inner side provided with the elongated member and bonding an overlapped portion to form a linear bonding portion, thereby turning the film into a tubular film; bonding a folded part and an unfolded part of the film along a transverse direction intersecting the bonding portion to form a bottom portion of the bag; packing contents in an inside of the tubular film; after the contents are packed in the inside of the film, bonding a folded part and an unfolded part of the film at a position remote from the bottom portion along the bonding portion to form a top portion of the bag; and cutting the film at the top portion of the bag or a part of the top portion located opposite a side of the top portion packed with the contents, where, in providing the tab, an outer edge of the tab is formed by providing a cutting line penetrating through the belt-shaped base and the film, and, in covering the tab with the protector, the protector is bonded on the surface of the film. A cutting area configured to cut the belt-shaped base in a manner intersecting a width direction of the tearing guide piece may be provided at a position adjacent to both ends of the cutting line.

In the above aspect of the invention, the units for performing the steps are installed in respective stages at a predetermined distance, and the film is fed so that these units are sequentially operable, thereby manufacturing the bag.

Initially, the step for providing the elongated member to the film is performed. Accordingly, the elongated member including the tearing guide piece and the zipper tape is formed in advance and the elongated member is fed onto a surface of the film so that the tearing guide piece of the elongated member faces the film and the belt-shaped base faces opposite the film, thereby providing the elongated member on the film. The steps for providing the elongated member on the film and the subsequent steps are the same as the steps in the above-described bag manufacturing method.

The manufacturing method of a bag according to the above aspect of the invention may include: cutting the film and the tearing guide piece in a manner intersecting the width direction of the tearing guide piece to form a cut portion in the tearing guide piece and the film each at a position different from the tab.

According to the above arrangement, the step for forming the cut portion is added to the above-described steps, so that a bag capable of controlling the location of the formed opening can be manufactured.

When the tab of the thus manufactured bag is pulled, the tearing guide piece rips the film to form an opening. When the pulled tearing guide piece reaches the cut portion, since the film and the tearing guide piece are cut at the cut portion, the film is not ripped beyond the cut portion.

A part of the belt-shaped base covering the tearing guide piece may be squashed to seal the cut portion.

DESCRIPTION OF EMBODIMENT(S)

Exemplary embodiments of the invention will be described with reference to attached drawings.

In the description of the exemplary embodiments, the same components will be denoted by the same reference signs and the explanation thereof will be omitted.

First Exemplary Embodiment

A first exemplary embodiment will be described below with reference to FIGS. 1 to 12.

A bag 1A according to the first exemplary embodiment will be described below with reference to FIGS. 1 to 5.

Figure 1:
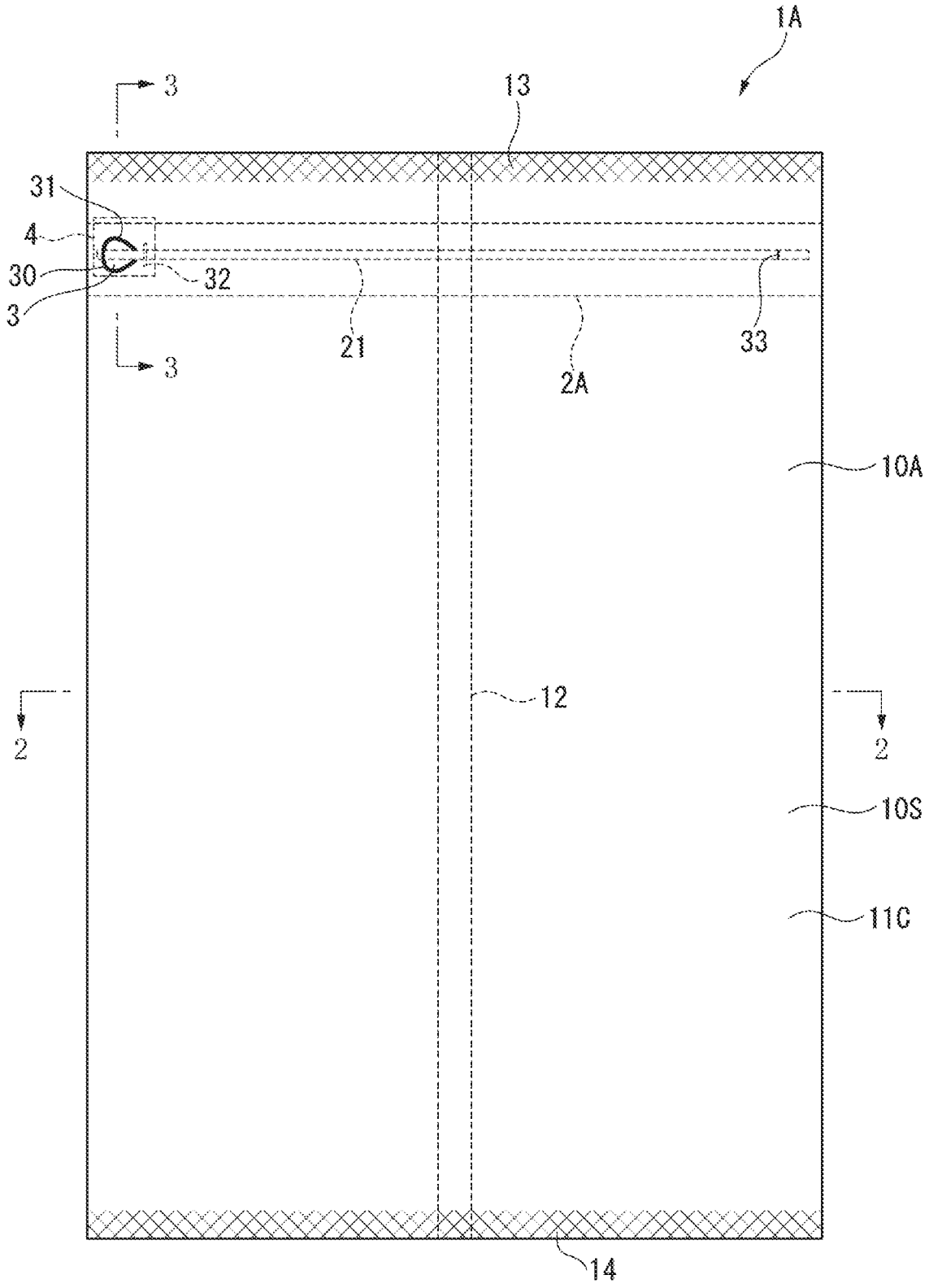
FIG. 1 is a front elevational view showing a bag according to a first exemplary embodiment of the invention.
Figure 2:
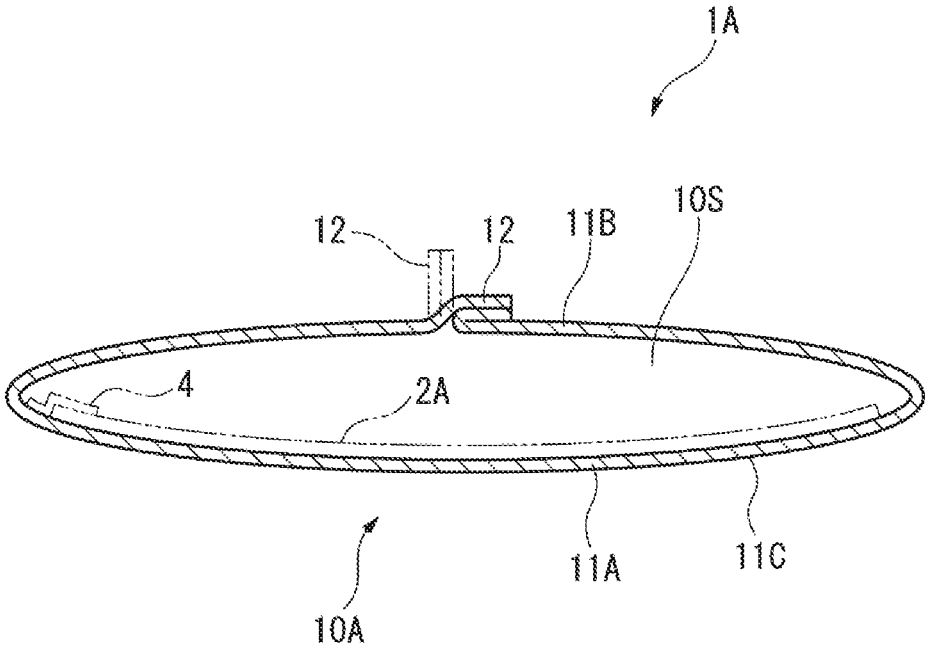
FIG. 2 is a cross-sectional view taken along 2-2 line in FIG. 1.

FIG. 1 shows an overall arrangement of the bag 1A. FIG. 2 shows a cross section of the bag 1A.

Overall Arrangement of Bag 1A

As shown in FIGS. 1 and 2, the bag 1A includes a bag body 10A, an elongated member 2A provided on the bag body 10A, a tab 3, and a protector 4.

Bag Body 10A

The bag body 10A includes a pair of mutually facing face portions 11A, 11B (only the face portion 11A is shown in FIG. 1) provided by inwardly folding peripheral ends of a single film 11C at a part remote from the peripheral ends by a predetermined dimension, a bonding portion 12 provided by linearly bonding the folded and overlapped portion of the film 11C, and a top portion 13 and a bottom portion 14 orthogonal to the bonding portion 12.

The first face portion 11A is a surface on which the bonding portion 12 is not formed. The second face portion 11B is a surface on which the bonding portion 12 is formed.

The bonding portion 12 is a part at which the film 11C is back-bonded. The bonding portion 12 may be provided through butt-seaming (bonding the same face of the film 11C as shown in FIG. 2) or may be provided through "envelope-seaming" (i.e. bonding different faces of the film 11C).

Figure 8:
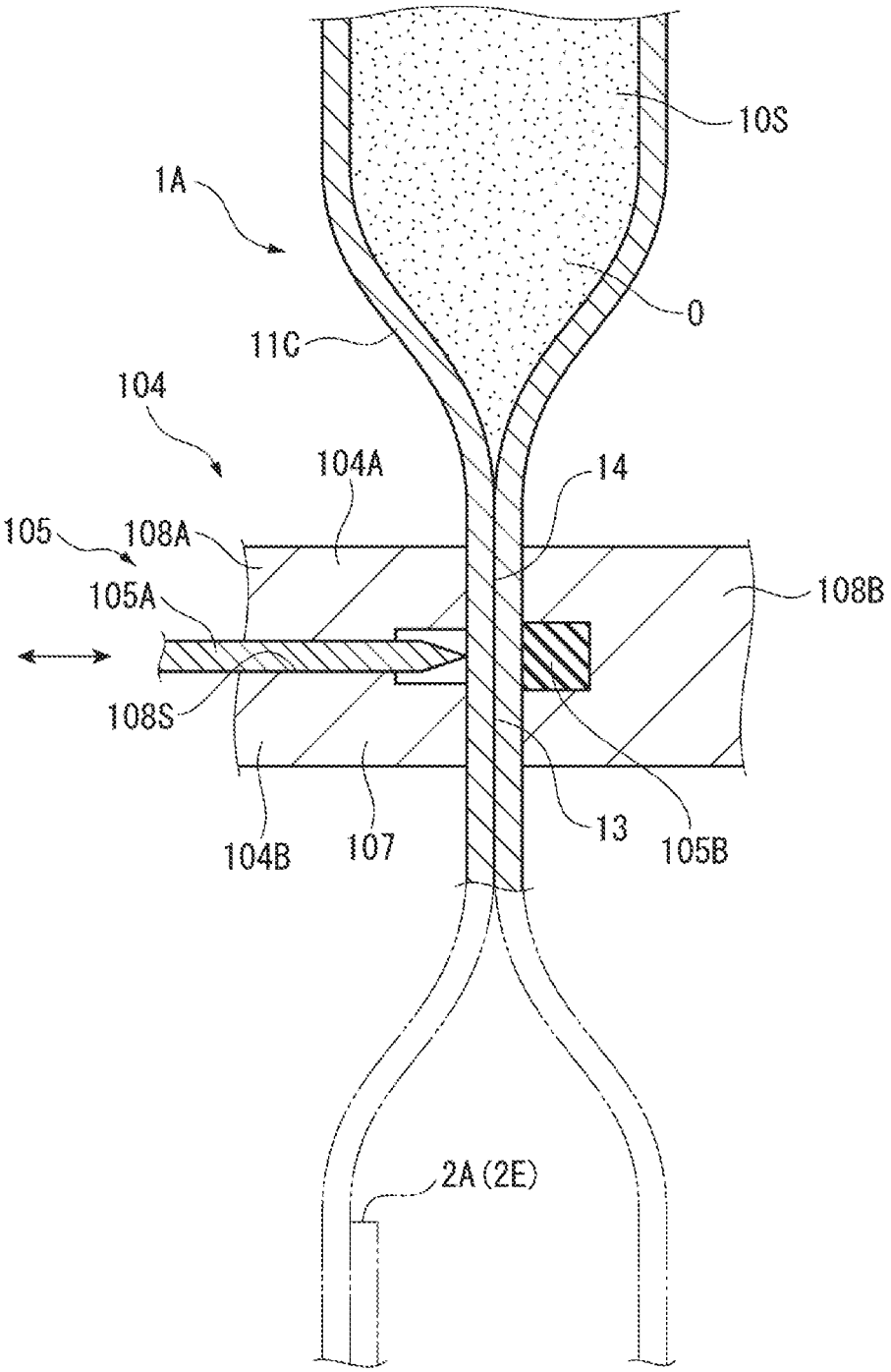
FIG. 8 is a cross-sectional view of a bonding unit and a cutting unit.

An inner space of the bag body 10A is a housing space 10S for housing contents O (see FIG. 8).

The film 11C may be a film made of a thermoplastic resin. Examples of the usable thermoplastic resin include low-density polyethylene (LDPE), linear low-density polyethylene (LLDPE), and polypropylene (PP). PP may be any of homopolypropylene (HPP), random polypropylene (RPP) and block polypropylene (BPP).

The top portion 13 and the bottom portion 14 are provided by bonding inner faces of the pair of face portions 11A, 11B are bonded.

Elongated Member 2A

Figure 3:
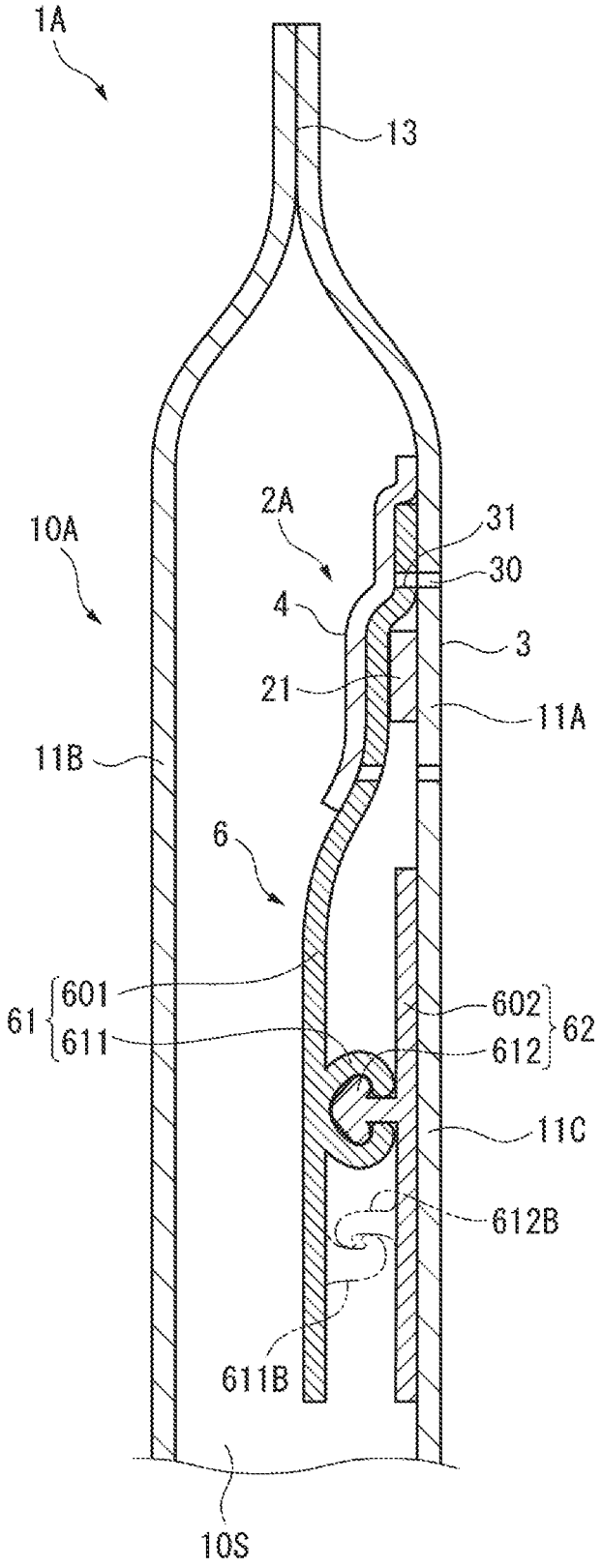
FIG. 3 is a cross-sectional view taken along 3-3 line in FIG. 1.
Figure 4:
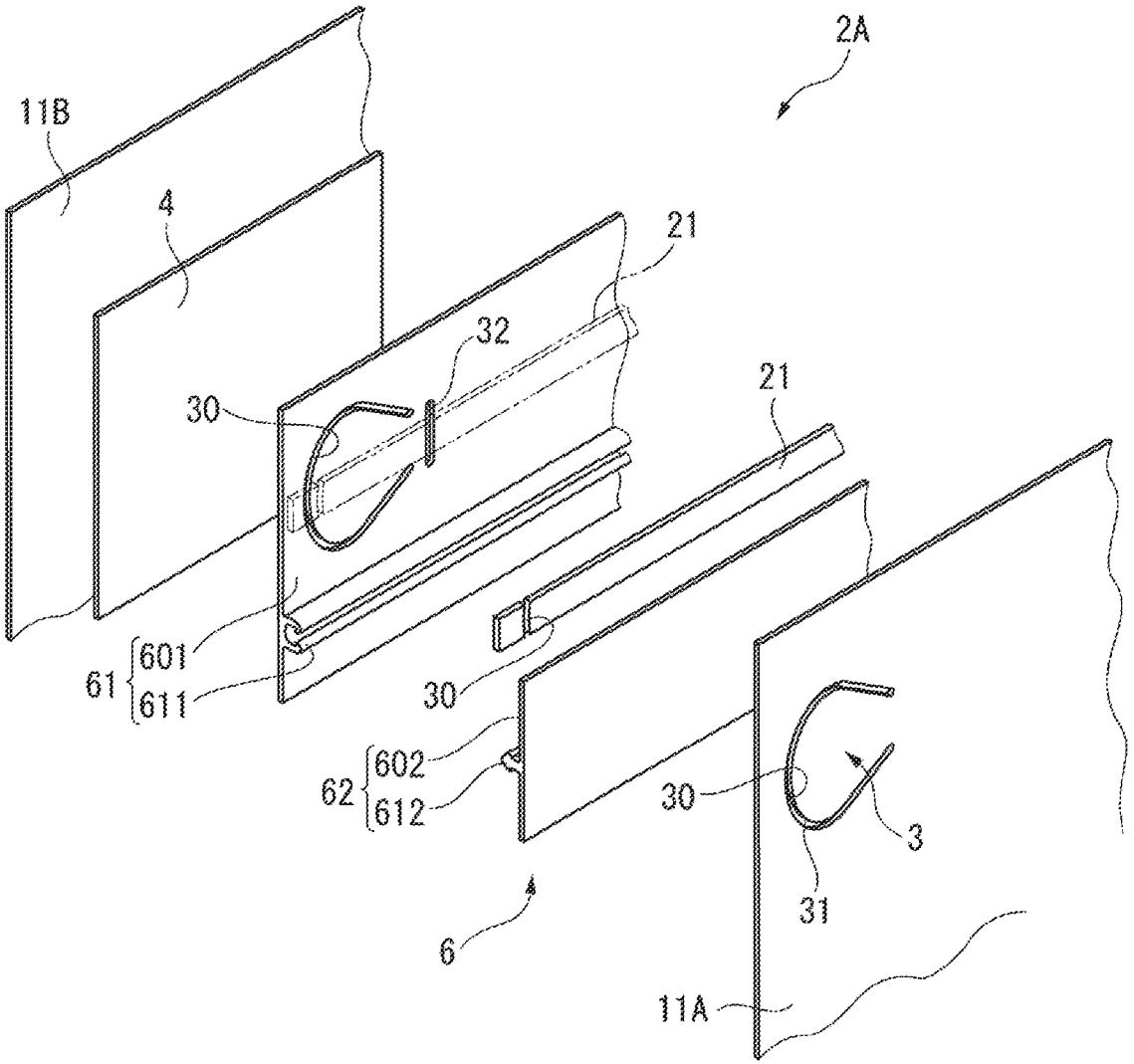
FIG. 4 is an exploded perspective view showing a vicinity of a tab of the bag.
Figure 5:
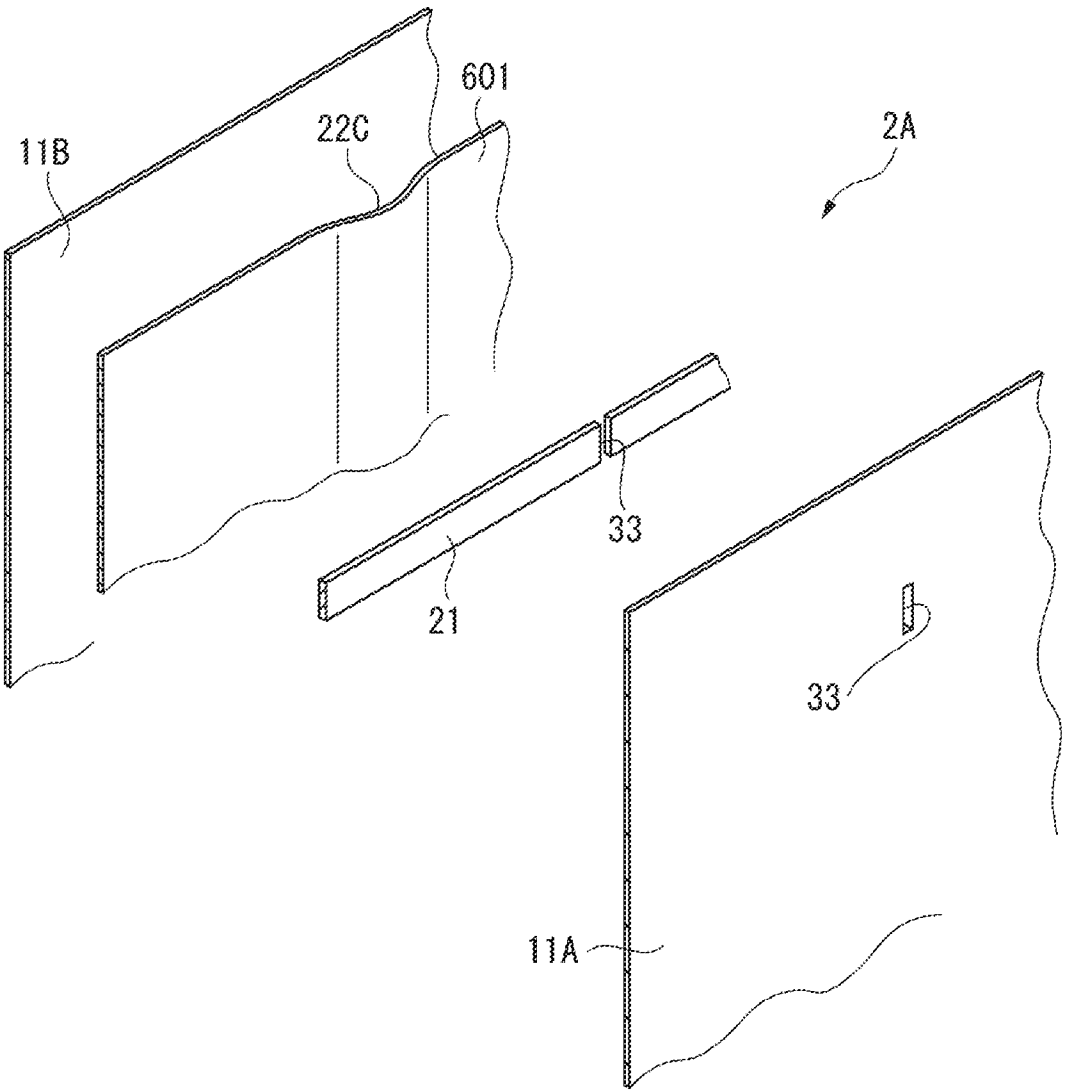
FIG. 5 is an exploded perspective view showing a vicinity of a cut portion of the bag.

Specific structures of the elongated member 2A are shown in FIGS. 3 to 5. A part of the elongated member 2A in the vicinity of the tab 3 is shown in FIGS. 3 and 4.

As shown in FIGS. 3 and 4, the elongated member 2A includes a tearing guide piece 21 and a zipper tape 6 that are bonded to the first face portion 11A.

The cross-sectional profile of the tearing guide piece 21 in a plane orthogonal to the longitudinal direction of the tearing guide piece 21 is rectangular in the illustrated example. However, the cross-sectional profile of the tearing guide piece 21 in the first exemplary embodiment is not necessarily rectangular but may be triangular or semicircular. Alternatively, the tearing guide piece 21 may be configured in a form of a cord.

The zipper tape 6 includes a first member 61 including a belt-shaped base 601 and a first engagement portion 611 continuous with the belt-shaped base 601, and a second member 62 including a belt-shaped body 602 and a second engagement portion 612 continuous with the belt-shaped body 602.

The first engagement portion 611 and the second engagement portion 612 are mutually engageable. The width of the belt-shaped base 601 is larger than that of the belt-shaped body 602, so that, when the first engagement portion 611 and the second engagement portion 612 are engaged, a first end in the width direction (i.e. an end near the top portion) of the belt-shaped base 601 extends beyond that of the belt-shaped body 602. The extended part of the belt-shaped base 601 and the belt-shaped body 602 are bonded to the first face portion 11A with a surface provided with the first engagement portion 611 and a surface not provided with the second engagement portion 612, respectively.

The first engagement portion 611 is a female portion and the second engagement portion 612 is a male portion engageable with the female portion in an example illustrated in FIGS. 3 and 4. However, the first engagement portion 611 and the second engagement portion 612 may alternatively be a male portion and a female portion, respectively.

Though only one pair of the first engagement portion 611 and the second engagement portion 612 is illustrated, a plurality of pairs of the first and second engagement portions may be provided.

Further, in addition to the first engagement portion 611 and the second engagement portion 612 as a combination of the male and female portions, a pair of mutually engaging hook-shaped portions 611B, 612B may be provided (see imaginary lines in FIG. 3). When the first engagement portion 611 and the second engagement portion 612 are provided by a combination of the pair of male and female portions and the two hook-shaped portions 611B, 612B, the hook-shaped portions 611B, 612B are provided opposite the extended part of the belt-shaped base 601 across the male and female portions, the hook-shaped portion 611B facing the extended part of the belt-shaped base 601 and the hook-shaped portion 612B facing the bottom portion 14. When the extended part of the belt-shaped base 601 is pulled upward in FIG. 3 and the belt-shaped body 602 is pulled downward in FIG. 3 while the male and female portions are engaged, a force (shear force) is applied on the belt-shaped base 601 and the belt-shaped body 602 in a direction away from each other within a plane, thereby mutually strongly engaging the hook-shaped portion 611B and the hook-shaped portion 612B in proportion to a tensile force to provide strong engagement between the male and female portions. In contrast, when the extended part of the belt-shaped base 601 and a part of the belt-shaped body 602 facing the extended part are pulled in a direction mutually away from each other, the male and female portions and the hook-shaped portions 611B, 612B are disengaged.

The belt-shaped base 601 is disposed between the second face portion 11B and the tearing guide piece 21 along the longitudinal direction of the tearing guide piece 21.

The materials for forming the tearing guide piece 21 and the zipper tape 6 are selected from among mutually incompatible resins. The incompatible resins are preferably a combination of low-density polyethylene resin and random polypropylene resin. Specifically, examples of the combination of incompatible resins include low-density polyethylene (LDPE)/random polypropylene (RPP), linear low-density polyethylene (LLDPE)/RPP (partially including m-LL), LDPE/homopolypropylene (HPP), LLDPE/HPP (partially including m-LL), LDPE/polystyrene (PS), LLDPE/PS (partially including m-LL), RPP/PS, HPP/PS, LDPE/polyethylene terephthalate (PET), LLDPE/PET, RPP/PET, HPP/PET, PS/PET, LDPE/nylon (Ny), LLDPE/Ny, RPP/Ny, HPP/Ny, and PS/Ny. Thus, interfacial delamination occurs at a bonding interface between the belt-shaped base 601 of the zipper tape 6 and the tearing guide piece 21.

Tab 3

The tab 3, which enables the tearing guide piece 21 to be pinched, is provided to a first end of the elongated member 2A in the longitudinal direction.

The tab 3 includes an outer edge 31 defined by a cutting line 30 penetrating through the first end of each of the belt-shaped base 601 and the tearing guide piece 21 in the longitudinal direction and the first face portion 11A. In other words, the tab 3 is defined by the belt-shaped base 601, the tearing guide piece 21 and the first face portion 11A in a region defined by the outer edge 31.

The outer edge 31 is a C-shaped part whose opening faces a second end of the elongated member 2B. The shape of the outer edge 31 is not particularly limited as long as the outer edge 31 is capable of defining the outer profile of the tab 3 and may be designed in any manner (e.g. semi-circle) in addition to the C-shape. Though the cutting line 30 is formed in the tearing guide piece 21 in FIGS. 3 and 4, the cutting line 30 in the tearing guide piece 21 can be omitted by shifting the position of the C-shape defined by the cutting line 30 in the longitudinal direction of the tearing guide piece 21.

A cutting area 32 for cutting the belt-shaped base 601 is provided adjacent to both ends of the cutting line 30 of the tab 3 at a position nearer to the second end of the elongated member 2A, the cutting area 32 intersecting the tearing guide piece in a width direction.

The cutting area 32 is disposed nearer to the second end of the belt-shaped base 22 with respect to the cutting line 30. Though the cutting area 32 is separated from the cutting line 30 in FIG. 4, the cutting area 32 may be continuous with the cutting line 30.

Protector 4

The protector 4, which covers the tab 3, is provided on a surface of the first face portion 11A provided with the belt-shaped base 601.

The protector 4 is made of a rectangular synthetic resin film. The material and shape of the protector 4 are not particularly limited in the first exemplary embodiment as long as the protector 4 is capable of covering the tab 3 to keep the housing space 10S of the bag 1A from being in communication with an exterior space of the bag 1A through the cutting line 30 defining the outer edge 31 of the tab 3. For instance, the shape of the protector 4 may be circular, ellipsoidal, triangular or the like. The protector 4 is bonded to the first face portion 11A and the belt-shaped base 601 at an outer periphery thereof. In other words, the protector 4 is not wholly bonded to the first face portion 11A and the belt-shaped base 601.

Cut Portion 33

A cut portion 33 is formed in the tearing guide piece 21 and the first face portion 11A at a position different from the tab 3 as shown in FIG. 1 (e.g. at the second end of the elongated member 2A in the longitudinal direction).

A specific structure of the cut portion 33 is shown in FIG. 5.

As shown in FIG. 5, the cut portion 33 is formed in the first face portion 11A and the tearing guide piece 21 in a manner to traverse the tearing guide piece 21 in the width direction. It should be noted that the cut portion 33 is not formed in the belt-shaped base 601.

In order to seal the cut portion 33, pressure may be applied to the belt-shaped base 601 from an inside and outside of the first face portion 11A. For instance, the belt-shaped base 601 may be squashed (i.e. pressed toward the first face portion 11A). It should be noted that the reference numeral 22C denotes an impression formed by the squashing.

Unsealing of Bag 1A

In order to unseal the above-described bag 1A after the contents are housed in the housing space 10S, the tab 3 is pulled in a direction away from the second face portion 11B, causing resistance in ripping the belt-shaped base 601. However, the resistance is reduced after the belt-shaped base 601 is torn apart at the cutting area 32. When the tab 3 is kept being pulled, the tearing guide piece 21, which is separated from the belt-shaped base 601, rips the first face portion 11A, unsealing the bag 1A along the longitudinal direction of the tearing guide piece 21. When the unsealed part of the bag 1A reaches the cut portion 33, at which the first face portion 11A and the tearing guide piece 21 are cut, the first face portion 11A is not ripped beyond the cut portion 33.

Film Assembly 5A

Next, a film assembly 5A will be described below with reference to FIG. 6.

Figure 6:
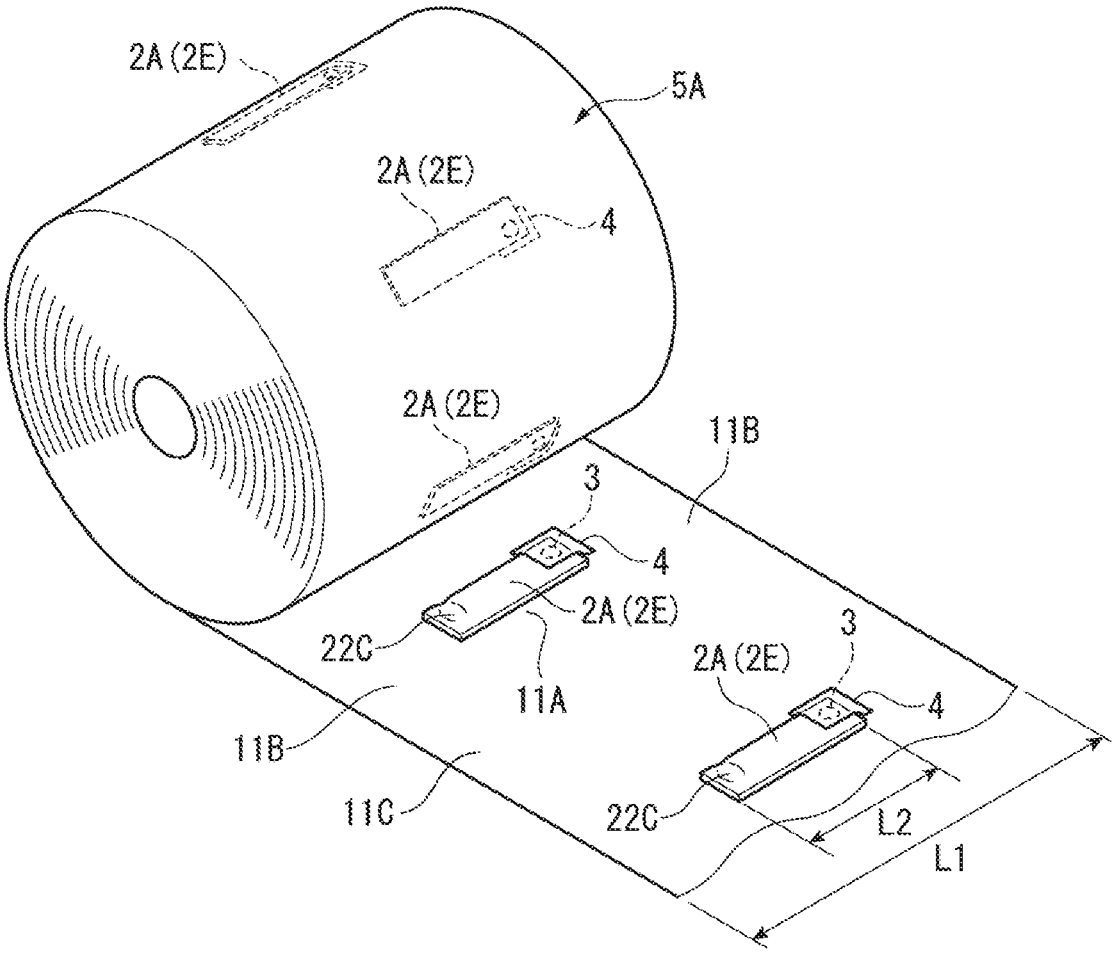
FIG. 6 is a perspective view showing a film assembly wound into a roll.

FIG. 6 shows an overall arrangement of the film assembly 5A wound into a roll.

As shown in FIG. 6, the film assembly 5A is provided by a series of the above-described bags 1A before the bonding portion 12, the top portion 13, and the bottom portion 14 are formed.

The film assembly 5A has a plurality of the elongated members 2B arranged mutually in parallel on a surface of the film 11C along a direction orthogonal to a feeding direction of the film 11C.

Manufacturing Machine and Manufacturing Method of Bag

Next, a manufacturing machine and a manufacturing method of the bag according to the first exemplary embodiment will be described below with reference to FIGS. 7 to 12.

Manufacturing Machine 100 and Manufacturing Method of Bag Using Film Assembly 5A Initially, a machine and a method for manufacturing the bag using the film assembly 5A will be described below with reference to FIGS. 7 and 8.

Figure 7:
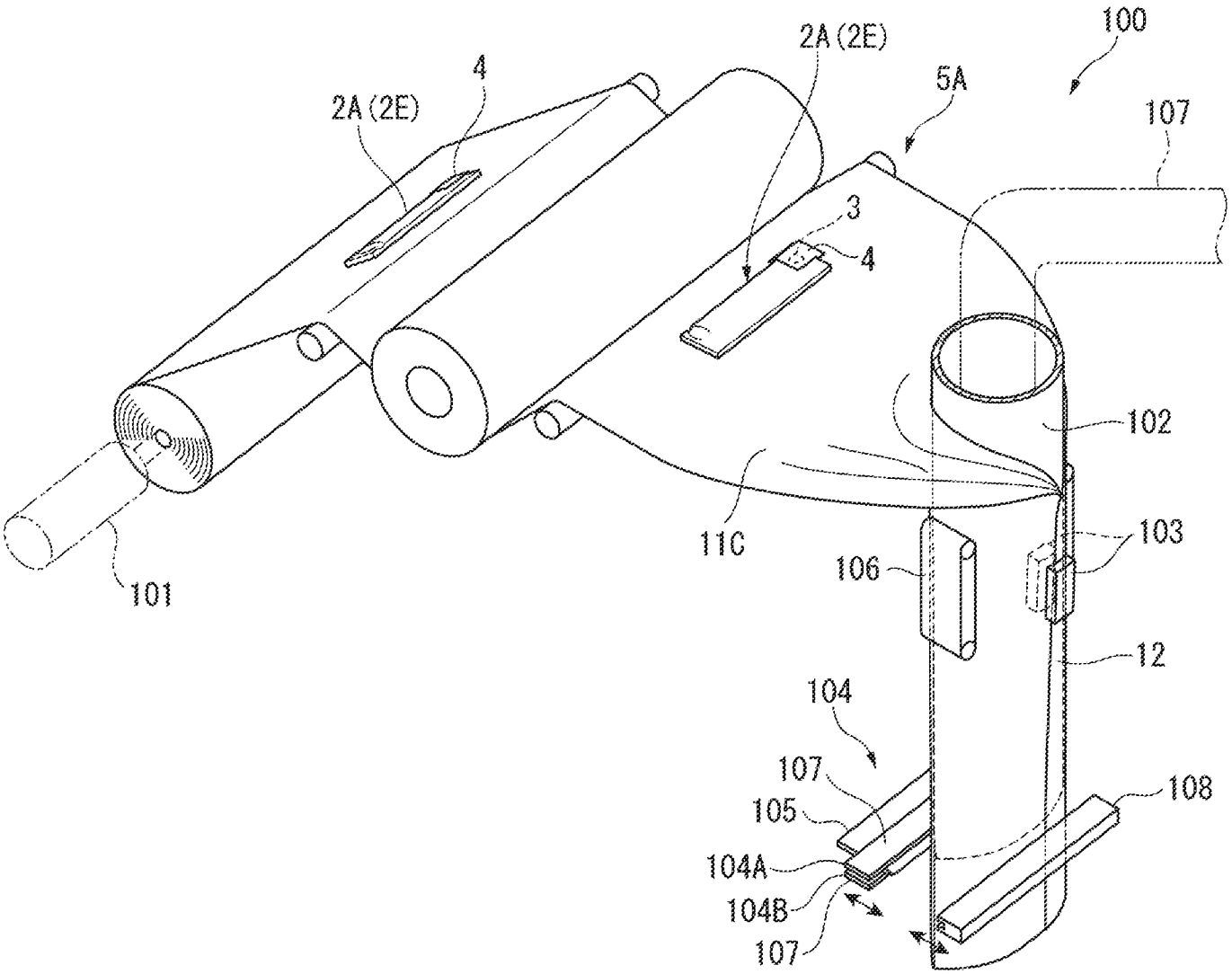
FIG. 7 is a perspective view showing an overall arrangement of a machine for producing the bag using the film assembly.

FIG. 7 shows an overall arrangement of the bag manufacturing machine 100.

As shown in FIG. 7, the bag manufacturing machine 100 is configured to continuously manufacture a plurality of the bags 1A housing the contents therein using the film assembly 5A.

The bag manufacturing machine 100 includes: a feeder 101 for feeding the film assembly 5A; a cylindrical former 102 for folding and overlapping peripheral ends of the film 11C of the film assembly 5A; a back-sealing unit 103 for bonding the overlapped peripheral ends of the film 11C to form the bonding portion 12; a bonding unit 104 for bonding the folded part and an unfolded part of the film 11C of the film assembly 5A provided with the bonding portion 12 along a transverse direction orthogonal to the bonding portion 12; a cutting unit 105 provided below the bonding unit 104; a feed belt 106 for feeding the film assembly 5A, whose peripheral ends are overlapped, toward the bonding unit 104; and a contents-packing unit 107 for packing the contents in the bag.

The cylindrical former 102 extends in a top-bottom direction. The bonding unit 104 and the cutting unit 105 are disposed below the cylindrical former 102. It should be noted that the bonding unit 104 and the cutting unit 105 are illustrated at close positions in FIG. 7 for illustrative purpose.

Specific structures of the bonding unit 104 and the cutting unit 105 are shown in FIG. 8.

As shown in FIG. 8, the bonding unit 104 includes a bottom former 104A and a top former 1048 for forming the bottom portion 14 and the top portion 13 of the bag 1A, respectively. The bottom former 104A and the top former 104B are integrated with a space 108S, in which the cutting unit 105 is disposed, being defined therebetween.

The top former 1048 and the top former 1048 each include a seal bar 108A and a seal bar 108B. The seal bar 108B is an integrated component common to the bottom former 104A and the top former 1048. The seal bar 108A and the seal bar 108B come close to each other to press the film 11C when the bottom portion 14 and the top portion 13 of the bag are formed, and move away from each other when the film 11C is descended.

The cutting unit 105, which is a device for cutting the film assembly 5A at a part between the top portion 13 of the bag at a forward side in the feeding direction of the film assembly 5A and the bottom portion 14 of the next bag, includes a cutter 105A and a cutter receiver 1058. The cutter receiver 1058 is made of rubber or the like.

A method for manufacturing the bag using the bag manufacturing machine 100 shown in FIG. 7 will be described below.

Initially, the film assembly 5A is fed to the cylindrical former 102 with the feeder 101. When the film assembly 5A is fed to the cylindrical former 102, the peripheral ends of the film 11C are folded inward (i.e. toward an inner surface on which the elongated member 2A is disposed) to be partially overlapped. The overlapped portion of the film 11C is bonded using the back-sealing unit 103 to form the linear bonding portion 12 and turn the film 11C into a tube.

The bottom former 104A bonds the unfolded part and folded part of the film 11C along the transverse direction orthogonal to the bonding portion 12 to form the linear bottom portion 14 of the bag.

Subsequently, the contents O is packed in the film 11C, which has been turned into a tubular film, using the contents-packing unit 107.

After the contents O is packed, the tubular film 11C is fed downward to a predetermined point, at which the top portion 13 is formed to the film 11C with the top former 1048.

Since the bottom former 104A and the top former 104B are integrated, the top portion 13 of the bag 1A at the forward side in the feeding direction of the film 11C is formed simultaneously with the bottom portion 14 of the next bag 1A.

Subsequently, the film 11C above the top portion 13 is cut using the cutting unit 105.

The above steps are repeated to continuously manufacture the bag 1A with the contents O being packed.

Manufacturing Machine 200 and Manufacturing Method of Bag without Using Film Assembly Next, a machine and a method for manufacturing the bag without using the film assembly will be described below with reference to FIGS. 9 to 11.

Figure 9:
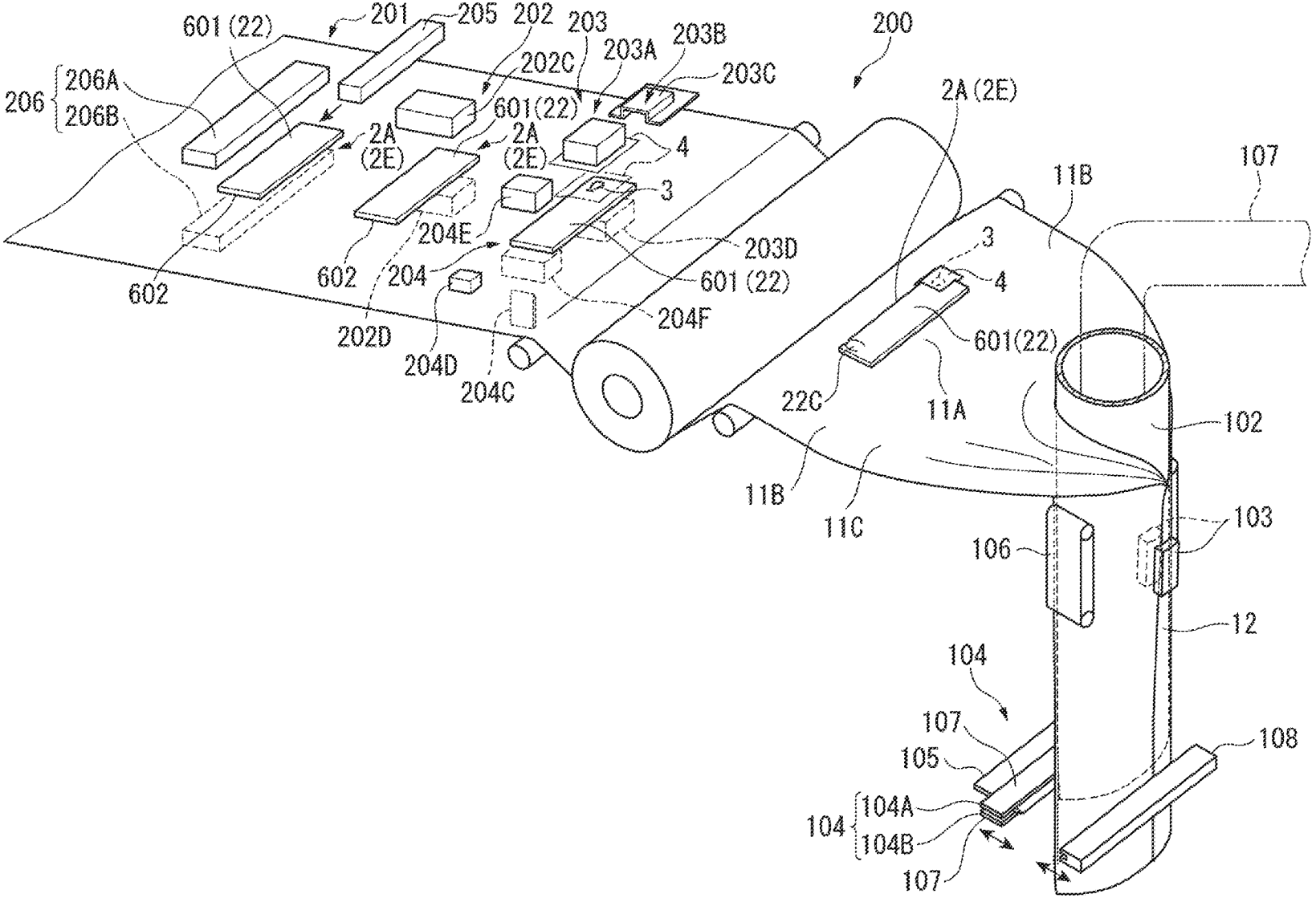
FIG. 9 is a perspective view showing an overall arrangement of a machine for producing the bag without using the film assembly.

FIG. 9 shows an overall arrangement of the machine for producing the bag without using the film assembly.

As shown in FIG. 9, a manufacturing machine 200 includes: an elongated-member attachment unit 201 for attaching the elongated member 2A on the film 11C; a tab former 202 for providing the tab 3 on the film 11C; a protector installation unit 203 for covering the tab 3 with the protector 4; a cut-portion former 204 for forming the cut portion 33 in the elongated member 2A; and the cylindrical former 102, the back-sealing unit 103, the bonding unit 104, the cutting unit 105, the feed belt 106 and the contents-packing unit 107 shown in FIG. 7.

The elongated-member attachment unit 201 includes an elongated-member feeding mechanism 205 for feeding the elongated member 2A on the film 11C, and an elongated-member bonding mechanism 206 for bonding the elongated member 2A, which has been fed on the film 11C, onto the film 11C.

The elongated-member feeding mechanism 205 is configured to feed the elongated member 2A, which is formed in advance through extrusion molding or the like, along the longitudinal direction so that the tearing guide piece 21 faces the film 11C.

The elongated-member bonding mechanism 206, which is configured to bond the tearing guide piece 21, the belt-shaped body 602, and a part of the belt-shaped base 601 onto the film 11C (see FIG. 3), includes a pair of seal bars 206A, 206B oppositely disposed across the film 11C and the elongated member 2A. These seal bars 206A, 206B come close to each other in bonding the elongated member 2A onto the film 11C and move away from each other after the bonding is completed. The seal bars 206A, 206B each includes a sealing unit such as a heat-sealer, and an ultrasonic sealer. It should be noted that an adhesive is usable in bonding the tearing guide piece 21, the belt-shaped body 602, and a part of the belt-shaped base 601 onto the film 11C. In this case, the adhesive applied in advance at a predetermined part may be pressed with a pair of bars.

Figure 10A:
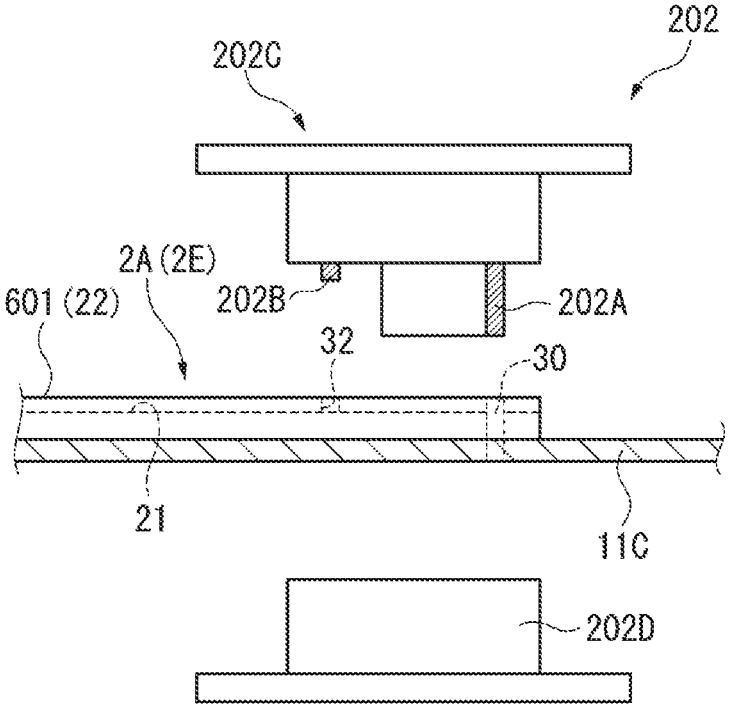
FIG. 10A is a cross-sectional view schematically showing a tab former.
Figure 10B:
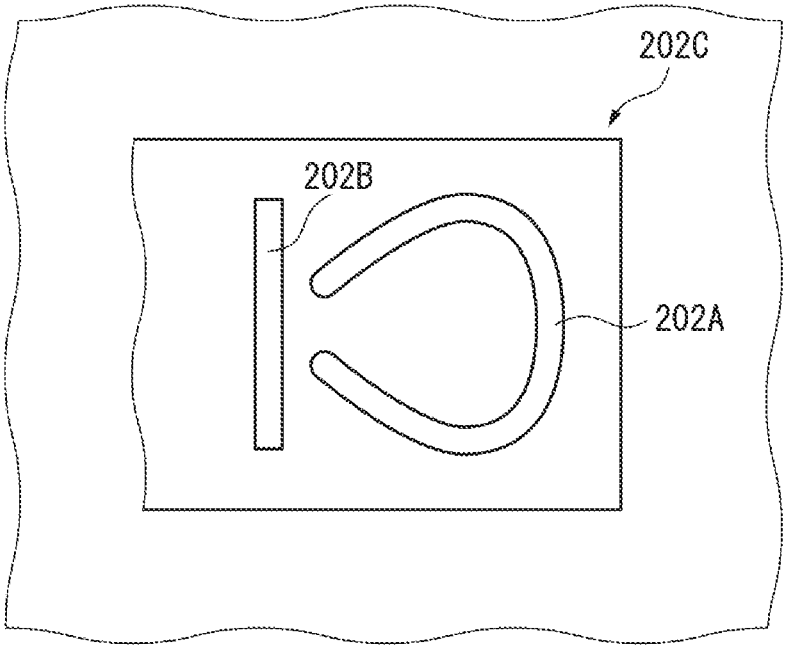
FIG. 10B is a plan view schematically showing the tab former.

Specific structure of the tab former 202 is shown in FIGS. 10A and 10B.

As shown in FIG. 10A, the tab former 202 is a cutting unit, which includes a blade 202C including a penetration blade 202A and a cutting blade 202B whose cutting depth is adjustable relative to the penetration blade 202A, and a receiver base 202D for receiving the blade 202C.

The penetration blade 202A is a blade configured to penetrate through the tearing guide piece 21, the belt-shaped base 601 and the film 11C to form the cutting line 30. The cutting blade 202B is a blade whose cutting depth with respect to the penetration blade 202A is adjusted so that the cutting blade 202B only cuts the belt-shaped base 601 without penetrating through the tearing guide piece 21 at a portion for the tearing guide piece 21 and the belt-shaped base 601 to be bonded. A cut amount of the penetration blade 202A is greater than a total of a thickness of the laminated tearing guide piece 21 and belt-shaped base 601 and a thickness of the film 11C. The cutting depth of the cutting blade 202B is the same as the thickness of the belt-shaped base 601.

As shown in FIG. 10B, the penetration blade 202A has the same C-shaped configuration (in a plan view) as the cutting line 30 of the tab 3, and the cutting blade 202B has the same linear shape as the cutting area 32.

Figure 11:
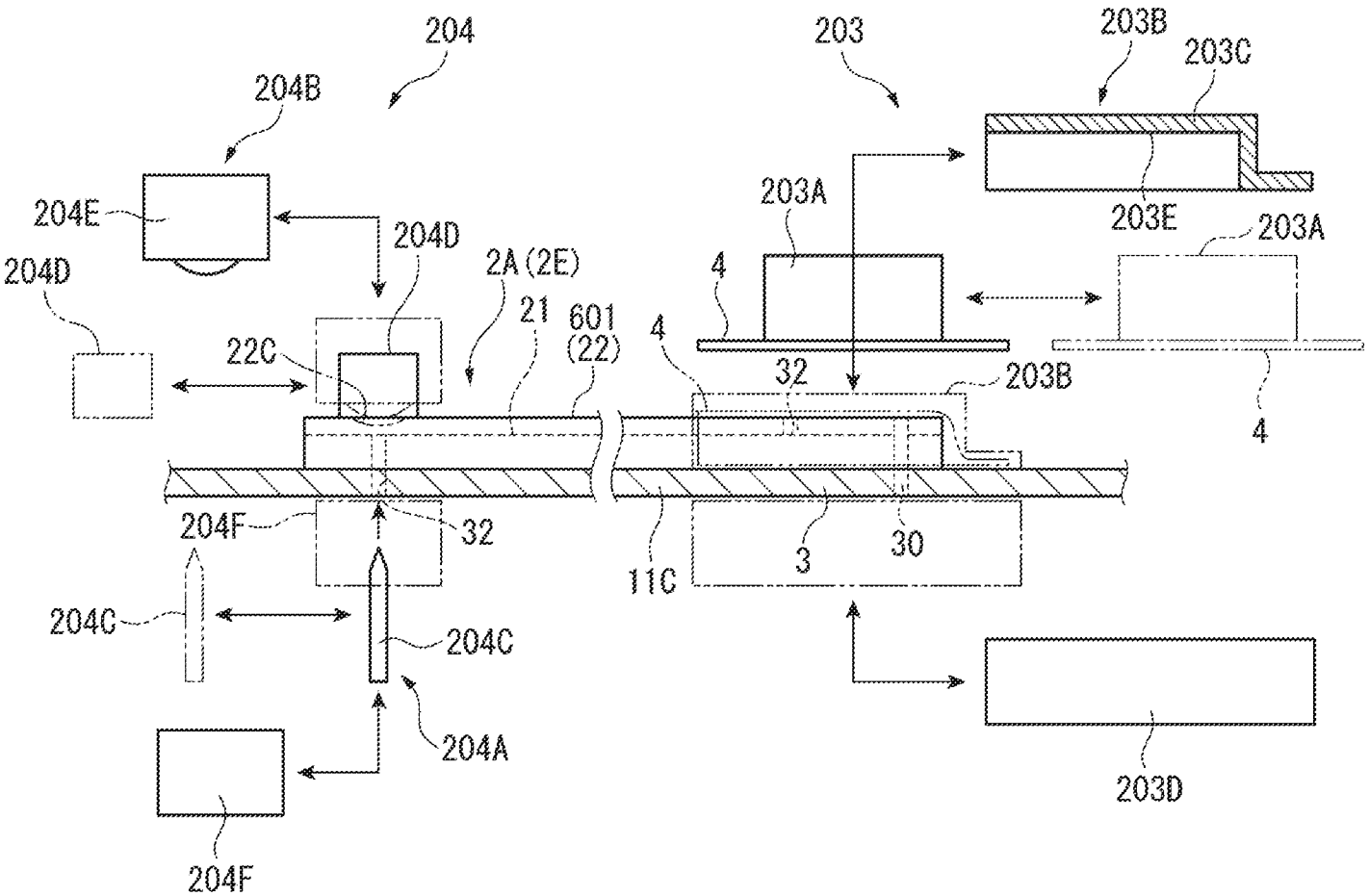
FIG. 11 schematically shows a protector installation unit and a cut-portion former.

Structures of the protector installation unit 203 and the cut-portion former 204 are shown in FIG. 11.

As shown in FIG. 11, the protector installation unit 203 includes a film placing unit 203A for placing the protector 4 to cover the tab 3, and a bonding mechanism 203B for bonding the periphery of the protector 4 onto the film 11C and the elongated member 2A.

The film placing unit 203A, which is a device with a sucking unit for holding the protector 4, is movable between a work position (directly above the tab 3) and a retracted position (off the tab 3).

The bonding mechanism 203B includes a seal portion 203C and a seal receiver 203D disposed across the elongated member 2A and the film 11C. The seal portion 203C and the seal receiver 203D are movable between a work position for bonding the protector 4 onto the elongated member 2A and the film 11C and a retracted position located off from the protector 4. The seal portion 203C is provided with a concave portion 203E corresponding to a corner of the elongated member 2A at the second end in order to sufficiently bond the corner and the film 11C with the protector 4. The seal portion 203C includes a sealing unit such as a heat-sealer, and an ultrasonic sealer.

The cut-portion former 204, which is movable between a work position at the second end of the elongated member 2A and a retracted position located off from the second end, includes a cutter body 204A for forming the cut portion 33 in the film 11C and the tearing guide piece 21, and a sealer 204B for squashing the belt-shaped base 601 over the cut portion 33 formed by the cutter body 204A to seal the cut portion 33.

The cutter body 204A includes a cutter 204C and a cutter receiver 204D.

The sealer 204B includes a pressing unit 204E with a projecting portion at an end and a receiver base 204F for receiving the pressing unit 204E. An impression 22C of squashing remains on the belt-shaped base 22 after being pressed by the pressing unit 204E.

In order to manufacture the bag 1A with the bag manufacturing machine 200 shown in FIG. 9, the elongated member 2B is delivered to a central portion of the film 11C by the elongated-member attachment unit 201 to place the elongated member 2A on a surface of the film 11C. Further, a first peripheral end of a second film 11E is bonded to the film 11C with the second-film-bonding unit 207.

Subsequently, the tab 3 is formed in the film 11C and the elongated member 2A by the tab former 202. In the tab former 202, the blade 202C and the receiver base 202D are moved toward the elongated member 2A and the film 11C, respectively. Then, the penetration blade 202A penetrates through the elongated member 2A and the film 11C to form the cutting line 30. Simultaneously, the cutting blade 202B linearly cuts the tearing guide piece 21 and the film 11C to form the cutting area 32.

Subsequently, after the tab 3 is covered with the protector 4 using the film placing unit 203A, the bonding mechanism 203B bonds a periphery of the protector 4 onto the film 11C and the elongated member 2A.

Further, the cut-portion former 204 forms the cut portion 33 in the belt-shaped base 601 of the elongated member 2A and the film 11C.

Subsequent steps are the same as those in the manufacturing method using the film assembly 5A.

Specifically, the film 11C provided with the elongated member 2A is fed to the cylindrical former 102. At the cylindrical former 102, the peripheral ends of the film 11C are folded inward (i.e. toward an inner side provided with the elongated member 2A) to be partially overlapped, the overlapped portion of the film 11C being bonded using the back-sealing unit 103 to form the bonding portion 12, turning the film 11C into a tube.

Then, after the bottom portion 14 of the bag 1A is formed by the bottom former 104A, the contents O is packed in the film 11C, which has been turned into a tubular film, using the contents-packing unit 107.

After the contents O is packed in the tubular film 11C, the film 11C is bonded at a position above the packed contents O to form the top portion 13. Further, the film 11C is cut at a part between the bottom portion 14 and the top portion 13 to produce an independent bag 1A.

Manufacturing Machine 300 and Manufacturing Method of Unpacked Bag Using Film Assembly 5A A machine and a method for manufacturing an unpacked bag 1A using the film assembly 5A will be described below with reference to FIG. 12.

A basic structure of a manufacturing machine 300 for the unpacked bag is the same as that of the manufacturing machine 100 shown in FIG. 7 except that the contents-packing unit 107 is not required and the bonding unit 104 and the cutting unit 105 have structures different from those of the example shown in FIG. 8.

Figure 12:
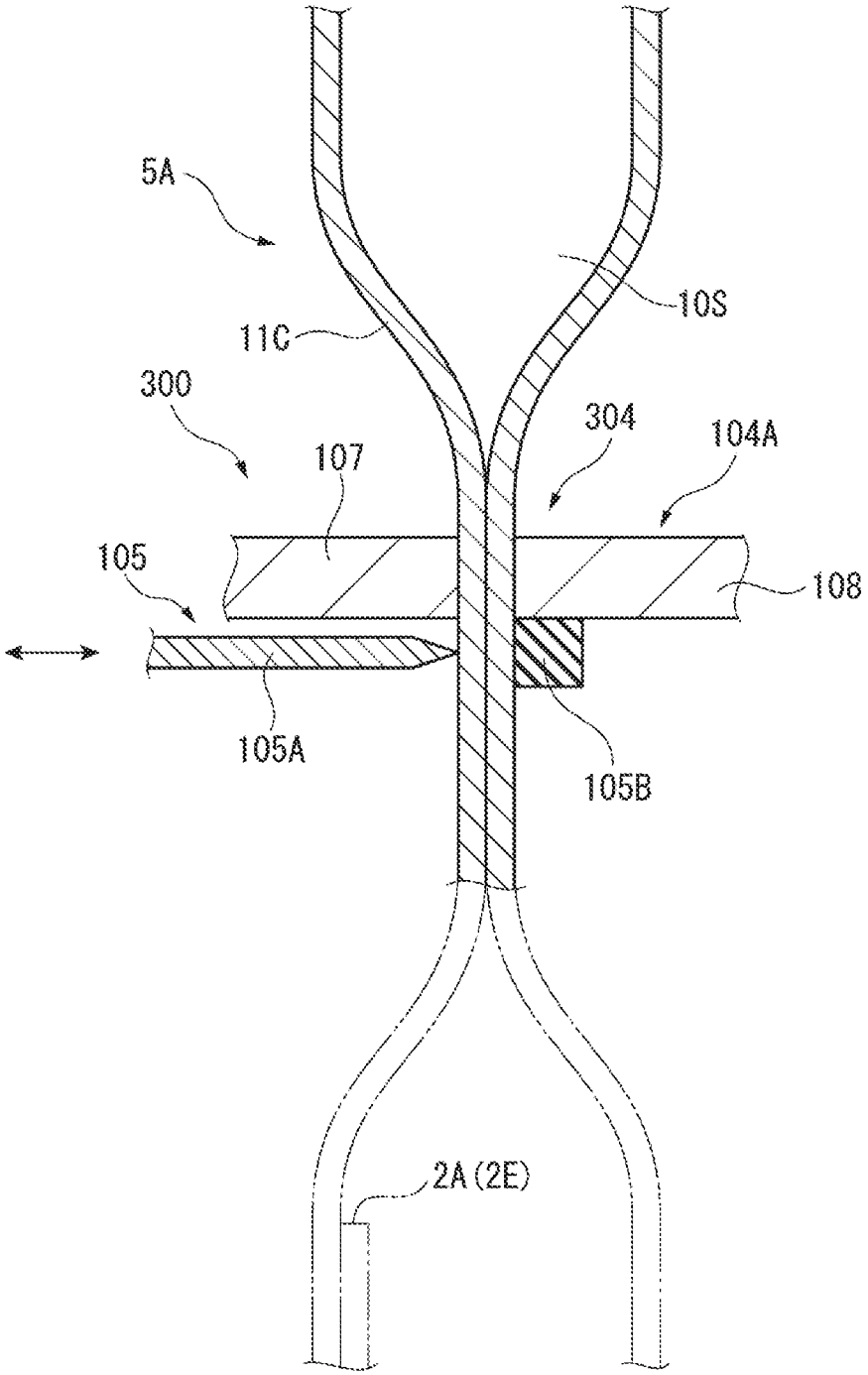
FIG. 12 shows a device for producing the bag before being packed with content, which corresponds to FIG. 8.

FIG. 12 shows a cross section of a relevant part of the bag manufacturing machine 300.

As shown in FIG. 12, the bag manufacturing machine 300 includes a bonding unit 304 and the cutting unit 105.

The bonding unit 304 includes no top former 104B but only has the bottom former 104A for forming the bottom portion 14 of the bag 1A.

The basic structure of the manufacturing machine 300 for the unpacked bag is the same as that of the manufacturing machine 100 shown in FIG. 10 except that the contents-packing unit 107 is not required and the bonding unit 104 and the cutting unit 105 have structures different from those of the example shown in FIG. 11.

FIG. 12 shows a cross section of a relevant part of the bag manufacturing machine.

As shown in FIG. 12, the bag manufacturing machine includes a bonding unit 304. The bonding unit 304 shown in FIG. 12 includes no top former 1048 but only has the bottom former 104A for forming the bottom portion 14 of the bag 1A.

The cutting unit 105 is adjacently provided below the bottom former 104A.

In order to manufacture the bag 1A using the film assembly 5A, in the same manner as in example shown in FIG. 7, the peripheral ends of the film 11C are folded inward (i.e. toward an inner side provided with the elongated member 2A) and the overlapped portion is bonded to form the bonding portion 12, turning the film 11C into a tube. The bottom former 104A bonds the unfolded part and folded part of the film 11C to form the bottom portion 14 of the bag 1A. Subsequently, the film 11C is cut in parallel to the bottom portion 14. Then, the film 11C is linearly cut by the cutting unit 105 in parallel to the bottom portion 14. The contents are housed in the bag 1A thus manufactured in a separate process with no top portion 13, and, subsequently, the top portion is formed on the bag 1A using a sealer (not shown).

The first exemplary embodiment offers the following advantages.

The elongated member 2A has the elongated tearing guide piece 21, the zipper tape 6, and the tab 3. The tab 3 includes the outer edge 31 defined by the cutting line 30 penetrating through the belt-shaped base 601 of the zipper tape 6 and the first face portion 11A of the bag body 10B. The cutting area 32 for cutting the belt-shaped base 601 is provided at a part of the tab 3 adjacent to both ends of the cutting line 30. The first face portion 11A is provided with the protector 4 covering the tab 3. Accordingly, before the bag 1A having the zipper tape 6 is unsealed, the housing space 10S is kept from being in communication with the exterior space through the cutting line 30, maintaining excellent sealability. Further, since the belt-shaped base 601 and the belt-shaped body 602 of the zipper tape 6 are bonded to the first face portion 11A, the contents O can be packed in the bag 1B without releasing the engagement between the first engagement portion 611 and the second engagement portion 612.

The cut portion 33 is formed through the tearing guide piece 21 and the first face portion 11A at a position different from the location of the tab 3, and the cut portion 33 traverse the first face portion 11A and the tearing guide piece 21 in the width direction of the tearing guide piece 21. Accordingly, the cut portion 33 defines a terminal of the portion to be ripped by the tearing guide piece 21, thus keeping the first face portion 11A from being ripped by the tearing guide piece 21 more than necessary. The cut portion 33 only cuts the first face portion 11A and the tearing guide piece 21 and does not cut the belt-shaped base 22. Accordingly, the housing space 10S of the bag body 10A is kept from being in communication with the exterior space through the cut portion 33 before the bag body 10A is unsealed.

The film assembly 5A, which includes a plurality of the mutually spaced apart elongated members 2A on one surface of the film 11C, the tab 3 provided through the elongated member 2A and the film 11C, and the protector 4, can be wound into a roll, allowing easy transportation of the film assembly 5A. Further, since the length of the film 11C along the longitudinal direction of the elongated member 2A is more than twice as large as the length of the elongated member 2A in the longitudinal direction, the film 11C can be turned into a tube by folding the peripheral ends of the film 11C inward from both ends of the elongated member 2A and bonding the overlapped portion to form the linear bonding portion 12.

In an example of the bag manufacturing method, the unpacked bag 1A can be continuously manufactured using the film assembly 5A by: feeding the film assembly 5A; folding the peripheral ends of the film 11C inward (i.e. toward inner side provided with the elongated member 2A); bonding the overlapped portion to form the bonding portion 12 and turn the film 11C into a tube; bonding the folded and unfolded parts of the film 11C along the transverse direction orthogonal to the bonding portion 12 to form the bottom portion 14 of the bag; and cutting the film 11C at a position opposite the bottom portion 14 across the elongated member 2A along the transverse direction of the film 11C in parallel to the bottom portion 14.

According to an example of the bag manufacturing method, the bag 1A packed with the contents can be continuously formed by: packing the contents O in an interior of the film 11C, which has been turned into a tube with the bottom portion 14 being formed; and bonding the folded and unfolded parts of the film 11C at a position remote from the bottom portion 14 to form the top portion 13 of the bag. In addition, since the elongated member 2A, which is provided on one surface of the film 11C, is spaced by a gap from the folded part of the film 11C, the contents can be delivered into the interior of the film 11C through the gap, allowing smooth packing process.

Second Exemplary Embodiment

Next, a second exemplary embodiment of the invention will be described with reference to FIGS. 13 to 18.

Overall Arrangement of Bag 1B

Figure 13:
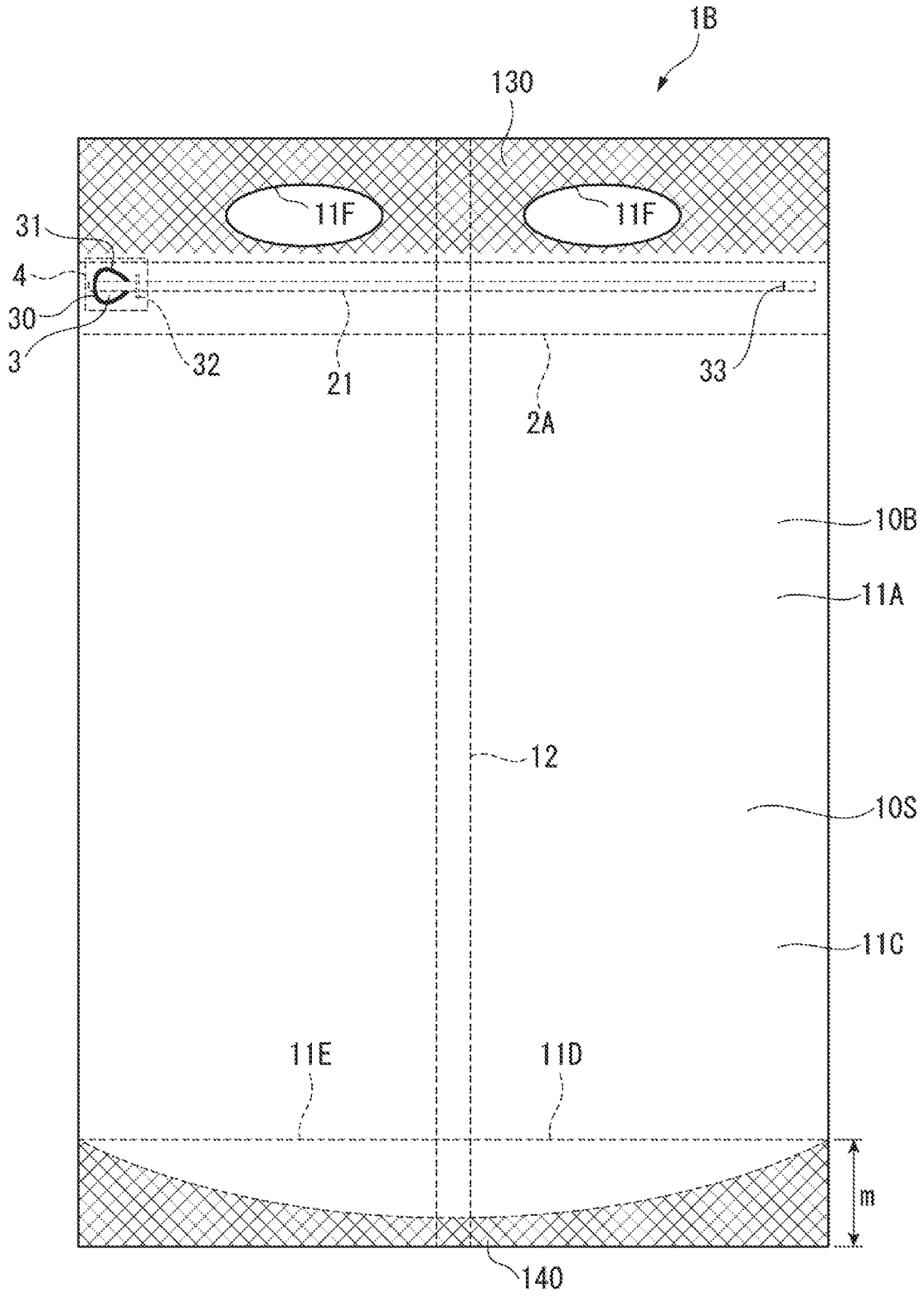
FIG. 13 is a front elevational view showing a bag according to a second exemplary embodiment of the invention.

FIG. 13 shows a bag 1B according to the second exemplary embodiment. The bag 1B according to the second exemplary embodiment is the same as the bag 1A according to the first exemplary embodiment except that a top portion 130 and a bottom portion 140 are structured differently from the top portion 13 and the bottom portion 14 of the bag 1A according to the first exemplary embodiment.

As shown in FIG. 13, the bag 1B includes the top portion 130 and the bottom portion 140.

Two grips 11F are provided in the top portion 130.

The configuration of the grip 11F is not particularly limited as long as the grip 11F can be held by hand. For instance, the grip may be suitably provided by: one or more hole-shaped grips provided to an upper end; a string inserted through the upper end of the bag body 10B; a grip member made of resin, metal or the like bonded to the upper end of the bag; or the like.

The bottom portion 140 is provided with a bottom face portion 11D. The bottom face portion 11D helps the bag 1B to stand upright while the contents O is housed in the housing space 10S.

The bottom face portion 11D is formed by bonding mutually opposite peripheral ends of the single second film 11E to an inner surface of each of the pair of face portions 11A, 11B. While the bag 1A is folded, the second film 11E is two-folded (i.e. folded in two). In contrast, while the bag 1A stands by oneself, a part of the bottom face portion 11D except for the periphery bonded to the pair of face portions 11A, 11B intersects the pair of face portions 11A, 11B.

The bottom portion 140 is a part at which the pair of face portions 11A, 11B and the second film 11E are bonded. While the bag 1B is folded, the bottom portion 140 shows an arc-shaped profile, where a dimension m of the bottom portion 140 along the longitudinal direction of the bonding portion 12 is small at a central portion at which the bonding portion 12 is formed, and increase from the central portion toward side edges of the bag body 10B. This is so designed that the two-folded second film 11E is unfolded to form the flat bottom face portion 11D when, for instance, the contents (not shown in FIG. 14) is packed in the housing space 10S of the bag 1B or the like to move sides of the bottom portion 140 adjacent to the pair of face portions 11A, 11B away from each other.

Film Assembly 5B

Next, a film assembly 5B will be described below with reference to FIG. 14.

Figure 14:
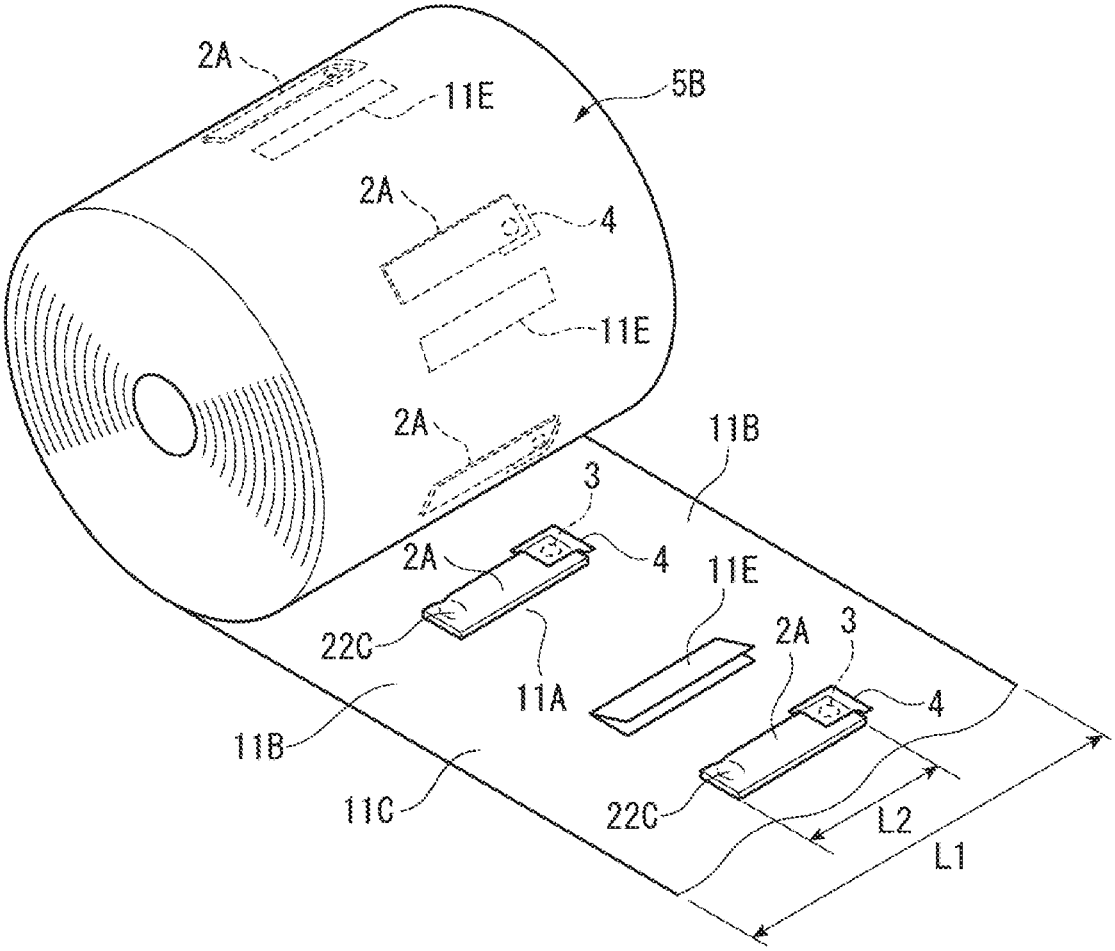
FIG. 14 is a perspective view showing a film assembly wound into a roll.

As shown in FIG. 14, the film assembly 5B has a plurality of the elongated members 2A arranged mutually in parallel on one surface of the film 11C along a direction orthogonal to the feeding direction of the film 11C. The first peripheral end of the two-folded second film 11E is bonded to the film 11C at a part between the elongated members 2A.

The second film 11E is disposed at the central portion of the film 11C while being two-folded. The second film 11E is two-folded so that mutually facing peripheral ends are aligned, one of the peripheral ends being bonded to the film 11C.

The central portion of the film 11C, on which the elongated member 2A and the second film 11E are provided, corresponds to the first face portion 11A. Both side portions of the film 11C across the elongated member 2A and the second film 11E correspond to the second face portion 11B.

Manufacturing Machine and Manufacturing Method of Bag

Next, a manufacturing machine and a manufacturing method of the bag according to the second exemplary embodiment will be described below with reference to FIGS. 15 to 18.

Manufacturing Machine 400 and Manufacturing Method of Bag Using Film Assembly 5B Initially, a machine and a method for manufacturing the bag using the film assembly 5B will be described below with reference to FIGS. 15 and 16.

Figure 15:
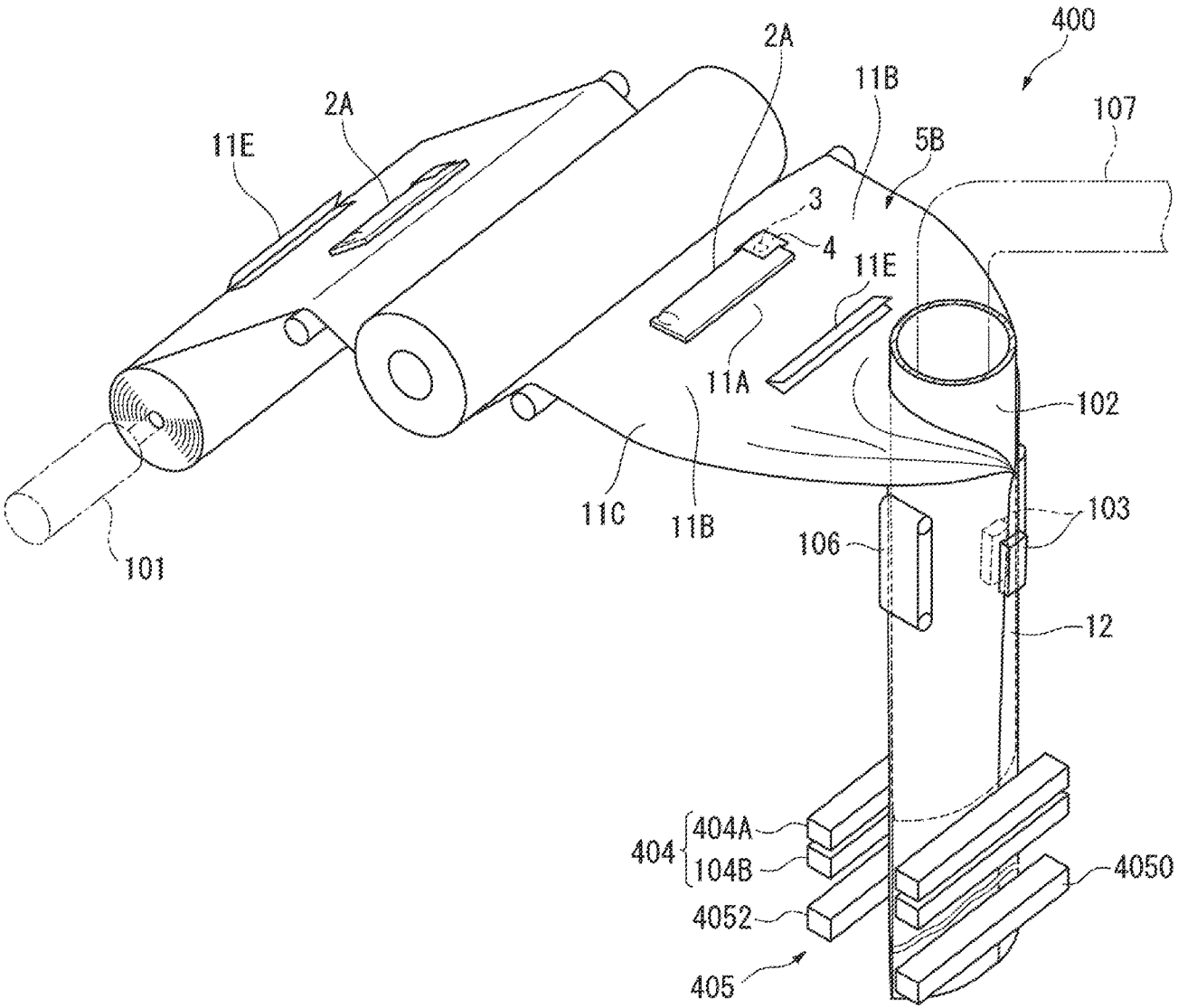
FIG. 15 is a perspective view showing an overall arrangement of a machine for producing the bag using the film assembly.

FIG. 15 shows an overall arrangement of the bag manufacturing machine 400.

The bag manufacturing machine 400 includes a bonding unit 404 and a cutting unit 405 whose structures are different from those in the first exemplary embodiment, in addition to the feeder 101, the cylindrical former 102, the back-sealing unit 103, the feed belt 106 and the contents-packing unit 107 in the first exemplary embodiment. It should be noted that the bonding unit 404 and the cutting unit 405 are closely illustrated in FIG. 15 for illustrative purpose.

Figure 16:
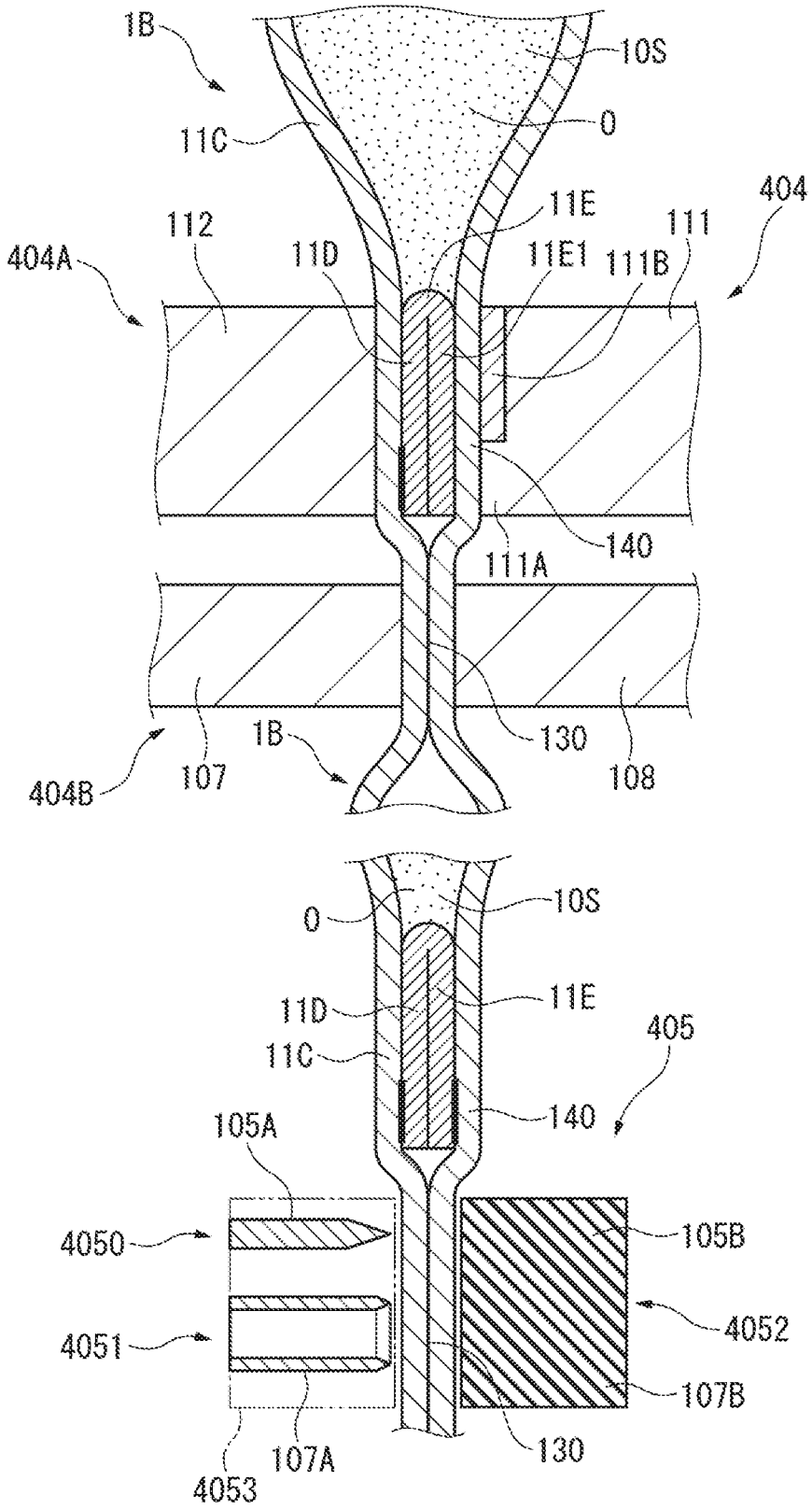
FIG. 16 is a cross-sectional view of a bonding unit and a cutting unit.

Specific structures of the bonding unit 404 and the cutting unit 405 are shown in FIG. 16.

As shown in FIG. 16, the bonding unit 404 includes a bottom former 404A and a top former 404B for forming the bottom portion 140 and the top portion 130 of the bag 1B, respectively. The bottom former 404A and the top former 404B are vertically arranged.

The top former 404B is configured to form the top portion 130 on the bag 1B at the front side of the film assembly 5B in the feeding direction. The bottom former 404A is configured to form the bottom portion 140 having the bottom face portion 11D on the bag 1B located next to the bag 1B at the front end.

The bottom former 404A includes a seal bar 111 for bonding a second peripheral end of the second film 11E onto the film 11C. A seal receiver 112 is disposed at a side at which the first peripheral end of the second film 11E is bonded to the film 11C in advance.

The seal bar 111 includes a film-abutment portion 111A for bonding the second peripheral end of the second film 11E onto the film 11C, and a spacer 111B for keeping a central portion 11E1 of the second film 11E from being bonded to the film 11C.

The seal bar 111 includes a sealing unit such as a heat-sealer and an ultrasonic sealer for bonding the film 11C with the peripheral end of the second film 11E. The specific structure of the spacer 111B is not particularly limited as long as the spacer 111B does not transfer the heat or ultrasonic vibrations of the seal bar 111 to the film 11C and the second film 11E. When, for instance, the seal bar 111 includes a heat-sealing bar, the spacer 111B may be made of a material that does not easily transfer heat.

In the second exemplary embodiment, a thickness of a film-overlapped portion corresponding to the bottom portion 140 is different from a thickness of a film-overlapped portion corresponding to the top portion 130. Specifically, the bottom portion 140, at which the bottom face portion 11D is formed by bonding the peripheral ends of the second film 11E to the film 11C, total four layers of the films are overlapped (i.e. two layers of the overlapped tubular film 11C plus two layers of the overlapped two-folded second film 11E).

Mutually facing portions of the tubular film 11C are bonded when the top portion 130 is formed by the top former 104B, resulting in two layers of the overlapped films. Thus, separate units are used for the top former 404B and the bottom former 404A.

The cutting unit 405 includes a cutting mechanism 4050 for cutting the film 11C between a part of the film 11C to be the bag 1B, whose top portion 130 has been formed by the top former 404B, and a part corresponding to a bag (not shown in FIG. 16) located at the front with respect to the bag 1B, and a punching mechanism 4051 for punching the top portion 130 of the bag at the front to form the grip 11F.

The cutting mechanism 4050 includes a cutter 105A, and a cutter receiver 105B.

The punching mechanism 4051 includes a punching blade 107A for punching the top portion 130 along the outer profile of the grip 11F, and a punching-blade receiver 107B. The cutter receiver 105B and the punching-blade receiver 107B are provided by a single rubber block 4052.

The cutter 105A and the punching blade 107A are housed in a common case 4053. The cutter 105A and the punching blade 107A are configured to advance toward the rubber block 4052 to cut or punch the film 11C. The cutter 105A and the punching blade 107A may be simultaneously advanced or the punching blade 107A may be advanced first.

A method for manufacturing the bag using the bag manufacturing machine 400 will be described below.

Initially, as in the first exemplary embodiment, the film assembly 5B is fed to the cylindrical former 102 by the feeder 101, the peripheral ends of the film 11C of the film assembly 5B being folded by the cylindrical former 102 to be partially overlapped. The overlapped portion of the film 11C is bonded using the back-sealing unit 103 to turn the film 11C into a tube.

Then, non-bonded peripheral end of the second film 11E is bonded to the film 11C with the bottom former 404A to form the bottom face portion 11D of the bag 1B.

Subsequently, as in the first exemplary embodiment, after the contents O is packed in the tubular film 11C by the contents-packing unit 107, the top portion 130 is formed to the film 11C with the top former 404B.

Subsequently, after the contents O is packed in the tubular film 11C by the contents-packing unit 107, the top portion 130 is formed to the film 11C with the top former 104B.

The top portion 130 of the bag at the front in the feeding direction of the film 11C and the bottom portion 140 of the next bag may be formed simultaneously or with a time lag.

Then, the grip 11F is formed to the top portion 130 with the punching mechanism 4051 and the film 11C is cut by the cutting mechanism 4050 at a part above the top portion 130.

The above steps are repeated to continuously manufacture the bag 1A the contents O is packed.

Manufacturing Machine 500 and Manufacturing Method of Bag without Using Film Assembly Next, a machine and a method for manufacturing the bag without using the film assembly will be described below with reference to FIG. 17.

Figure 17:
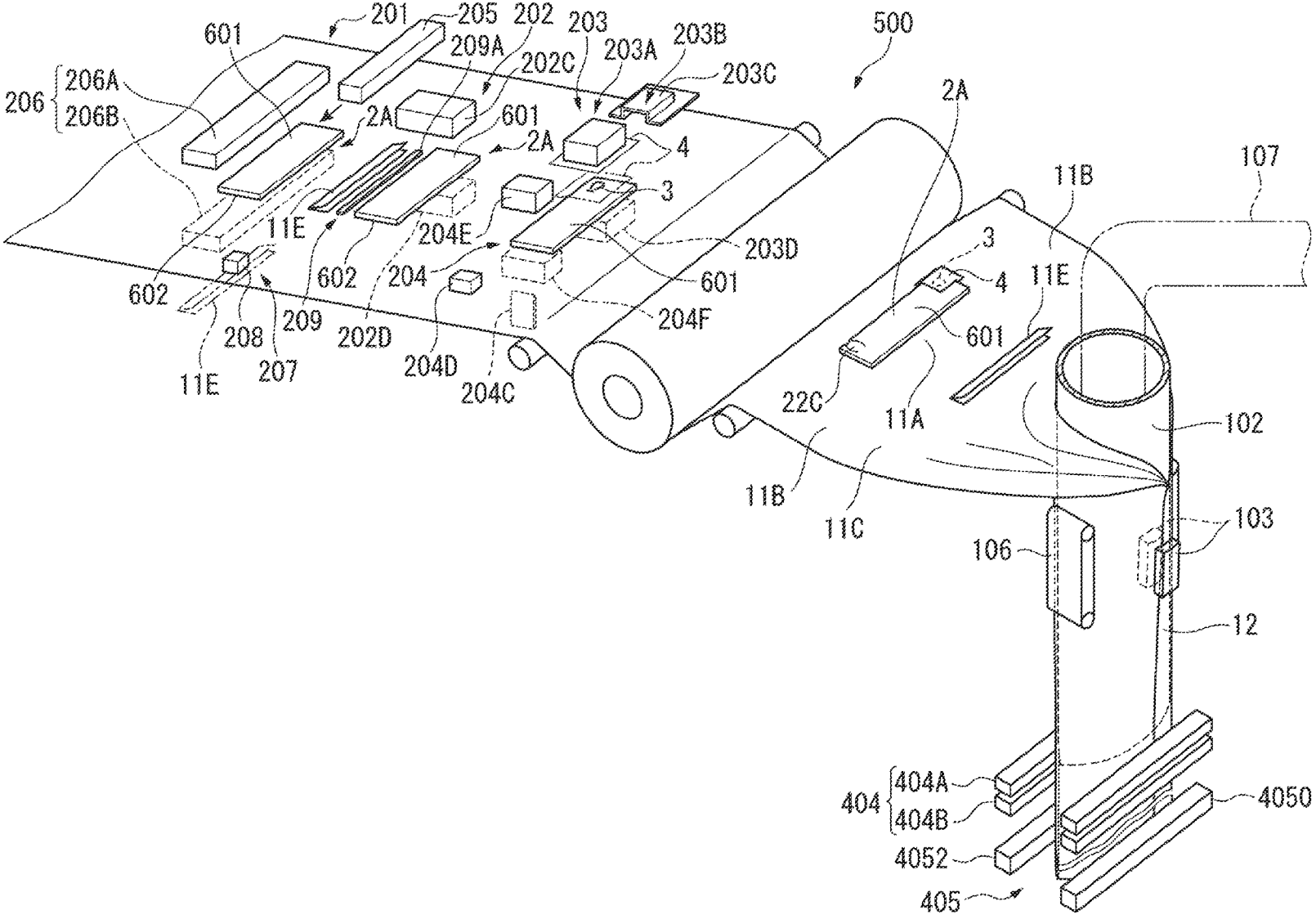
FIG. 17 is a perspective view showing an overall arrangement of a machine for producing the bag without using the film assembly.

FIG. 17 shows an overall arrangement of the machine for producing the bag without using the film assembly.

As shown in FIG. 17, the manufacturing machine 500 includes: the elongated-member attachment unit 201, the tab former 202, the protector installation unit 203, the cut-portion former 204, the cylindrical former 102, the back-sealing unit 103, the feed belt 106, and the contents-packing unit 107 described in the first exemplary embodiment; the bonding unit 404 and the cutting unit 405 shown in FIG. 15; and the second-film-bonding unit 207 for bonding a peripheral end of the second film 11E to the film 11C.

The second-film-bonding unit 207 includes a film holder 208 for placing the second film 11E, which has been preliminarily two-folded, at the central portion of the film 11C at a position remote from the elongated member 2A, and a sealer 209 for bonding the peripheral end of the second film 11E onto the film 11C.

The sealer 209 includes a seal bar (not shown) disposed below the film 11C, and a seal receiver 209A disposed opposite the seal bar across the film 11C. The seal bar may include a sealing unit such as a heat-sealer and an ultrasonic sealer. Alternatively, the seal bar may be configured to bond the peripheral end of the second film 11E onto the film 11C with an adhesive.

In order to manufacture the bag 1B with the bag manufacturing machine 500, the elongated member 2B is delivered to the central portion of the film 11C by the elongated-member attachment unit 201 to place the elongated member 2A on a surface of the film 11C. Further, the peripheral end of the second film 11E is bonded to the central portion of the film 11C with the second-film-bonding unit 207.

Subsequently, the tab 3 is formed in the film 11C and the elongated member 2A by the tab former 202.

Then, after the tab 3 is covered with the protector 4 using the film placing unit 203A, the bonding mechanism 203B bonds a periphery of the protector 4 onto the film 11C and the elongated member 2A.

Further, the cut-portion former 204 forms the cut portion 33 in the belt-shaped base 601 of the elongated member 2A and the film 11C.

Subsequent steps are the same as those in the manufacturing method using the film assembly 5B.

Specifically, the film 11C provided with the elongated member 2A is fed to the cylindrical former 102. At the cylindrical former 102, the peripheral ends of the film 11C are folded inward (i.e. toward an inner side provided with the elongated member 2A) to be partially overlapped, the overlapped portion of the film 11C being bonded using the back-sealing unit 103 to form the bonding portion 12, turning the film 11C into a tube.

Then, after the bottom portion 140 of the bag 1A is formed by the bottom former 144A, the contents O is packed in the film 11C, which has been turned into a tube, using the contents-packing unit 107.

The film 11C is bonded at a position above the packed contents O to form the top portion 130, in which the grip 11F is formed. Further, the film 11C is cut at a part between the bottom portion 140 and the top portion 130 to form an independent bag 1B.

Manufacturing Machine 600 and Manufacturing Method of Unpacked Bag Using Film Assembly 5B A machine and a method for manufacturing an unpacked bag 1B using the film assembly 5B will be described below with reference to FIG. 18.

The basic structure of a manufacturing machine 600 for the unpacked bag is the same as that of the manufacturing machine 400 shown in FIG. 15 except that the contents-packing unit 107 is not required and the bonding unit 404 and the cutting unit 405 have structures different from those of the example shown in FIG. 16.

Figure 18:
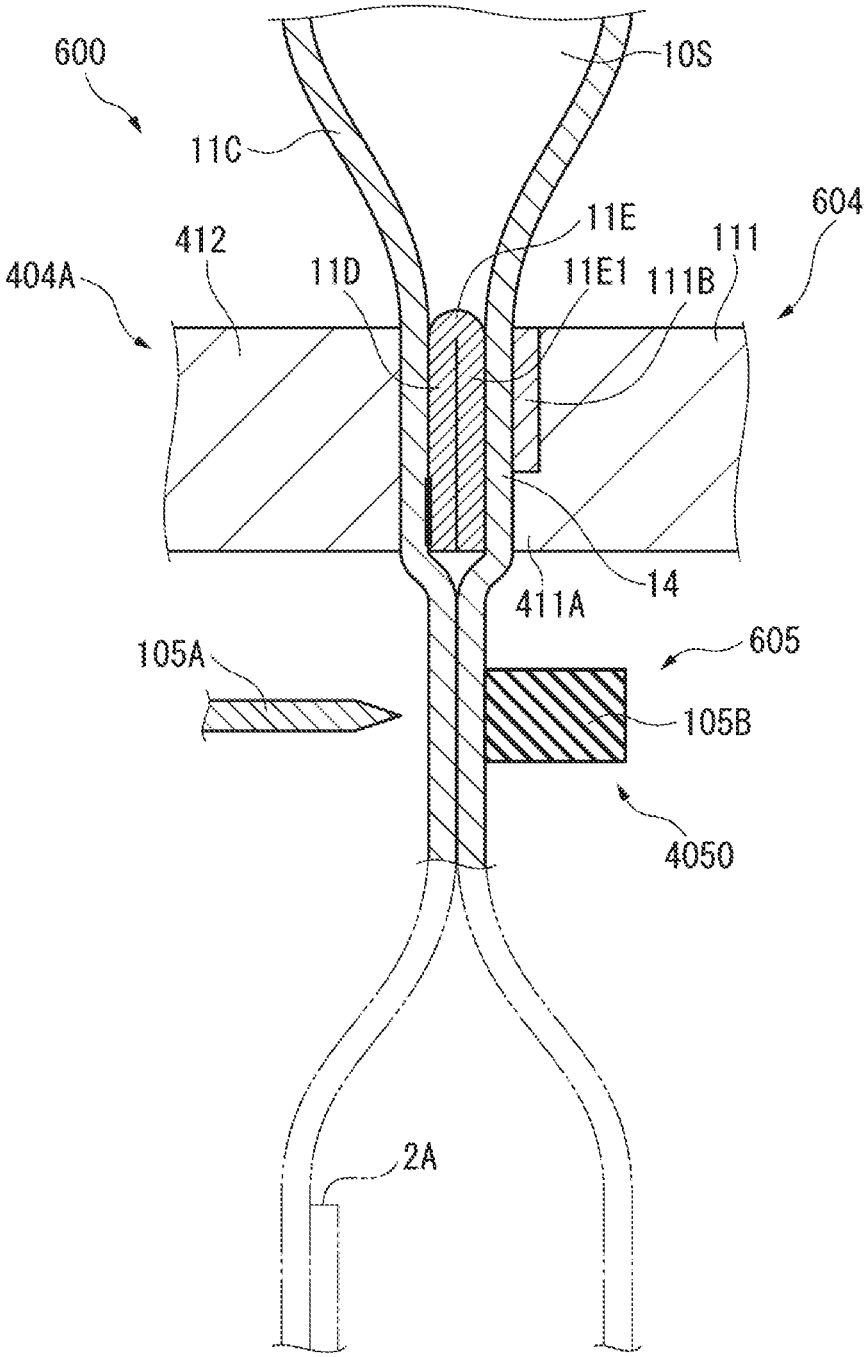
FIG. 18 shows a device for producing the bag before being packed with content, which corresponds to FIG. 16.

FIG. 18 shows a cross section of a relevant part of the bag manufacturing machine 600.

As shown in FIG. 18, the bag manufacturing machine 600 includes a bonding unit 604 and the cutting unit 605.

The bonding unit 604 includes no top former 404B but only has the bottom former 104A for forming the bottom portion 140 of the bag 1B.

The cutting unit 605 includes the cutting mechanism 4050 and has no punching mechanism 4051.

In order to manufacture the bag 1B before the contents are packed using the film assembly 5B, the peripheral ends of the film 11C are folded inward (i.e. toward an inner side provided with the elongated member 2B) using the cylindrical former 102 and the overlapped portion is bonded to form the bonding portion 12, turning the film 11C into a tube.

Then, the second peripheral end of the two-folded second film 11E is bonded to an inner surface of the film 11C by the bottom former 404A to form the bottom portion 140. Subsequently, the film 11C is cut by the cutting unit 405 in parallel to the bottom portion 140.

The second exemplary embodiment offers the following advantages in addition to the advantages of the first exemplary embodiment.

The bag body 10B includes mutually facing pair of face portions 11A, 11B and the bottom face portion 11D bonded to the pair of face portions 11A, 11B at peripheral ends thereof. It is expectable that the bag 1B can stand upright while the contents O is housed in the housing space 10S, due to the presence of the bottom face portion 11D.

Since the grip 11F is provided to the bag body 10B, the bag 1B can be easily held.

Third Exemplary Embodiment

Next, a bag 1C according to a third exemplary embodiment of the invention will be described with reference to FIGS. 19 to 21.

The third exemplary embodiment is the same as the first exemplary embodiment except for the structure of the elongated member.

Figure 19:
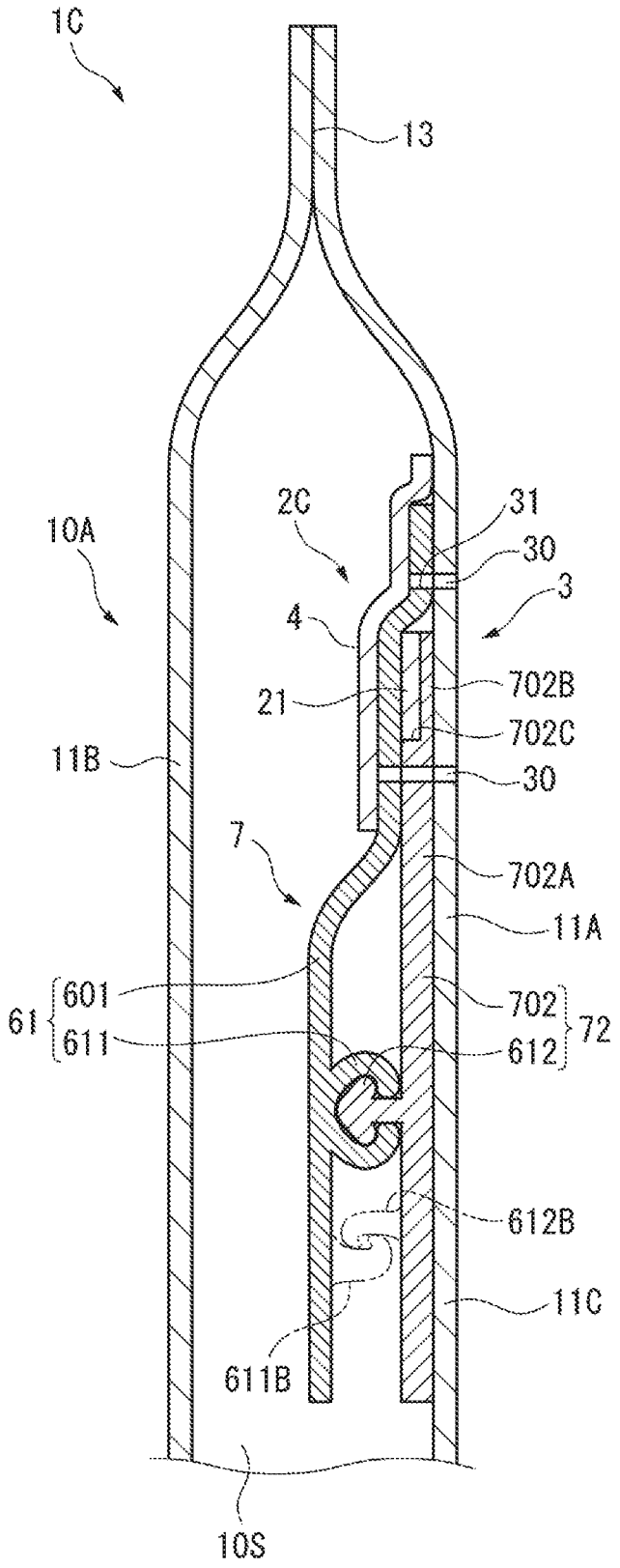
FIG. 19, which corresponds to FIG. 3, is an illustration showing a cross section of a relevant part of a bag according to a third exemplary embodiment of the invention.
Figure 20:
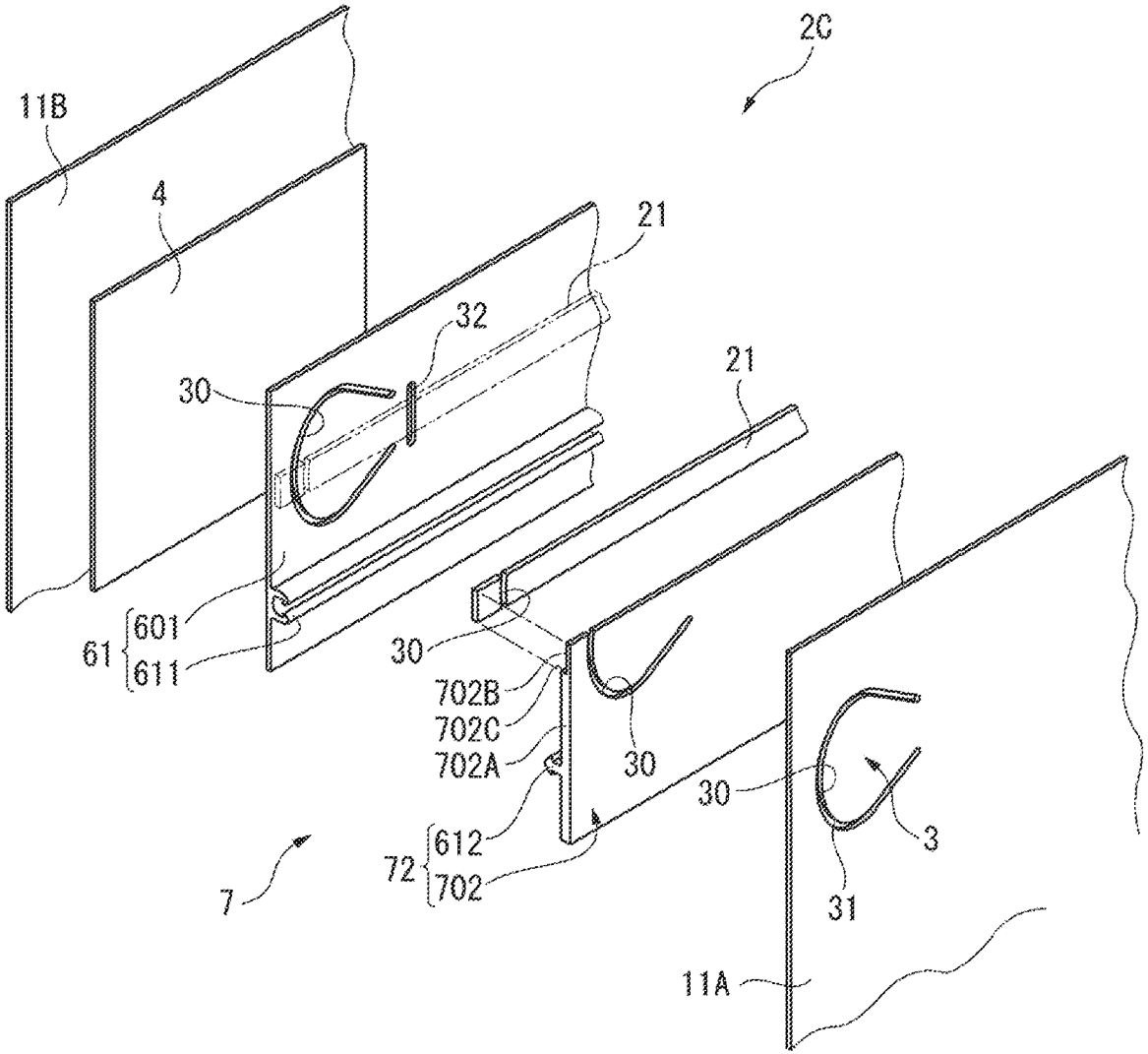
FIG. 20 is an exploded perspective view showing a vicinity of a tab of the bag.

As shown in FIGS. 19 and 20, the bag 1C includes the bag body 10A, an elongated member 2C provided on the bag body 10A, the tab 3, and the protector 4.

Elongated Member 2C

The elongated member 2C includes the tearing guide piece 21 and the zipper tape 7.

The zipper tape 7 includes the first member 61 and a second member 72 including a belt-shaped body 702 and the second engagement portion 612 continuous with the belt-shaped body 702. The zipper tape 7 is made of the same material as the zipper tape 6 according to the first exemplary embodiment.

The belt-shaped body 702 includes a belt-shaped body portion 702A bonded to the first face portion 11A and provided with the second engagement portion 612, and a thin portion 702B formed at an end of the body portion 702A near the top portion 13, the thin portion 702B being thinner than the body portion 702A. The thin portion 702B has a surface bonded with the tearing guide piece 21, the surface being orthogonal to an end face of the body portion 702A facing the top portion 13, the end surface of the body portion 702A guiding a ripping movement of the tearing guide piece 21. It should be noted that the thickness of the body portion 702A may alternatively be the same as the thickness of the thin portion 702B. In this case, a projecting portion for guiding the ripping direction of the tearing guide piece 21 may be provided on the body portion 702A. Further alternatively, the tearing guide piece 21 may be laminated on a flat body portion 702A without providing the projecting portion. In other words, the attachment structure of the tearing guide piece 21 is not limited as long as the tearing guide piece 21 is provided to the first face portion 11A through the belt-shaped body 702.

It should be noted that, in addition to or in place of the first engagement portion 611 and the second engagement portion 612 as a combination of the male and female portions, a pair of mutually engaging hook-shaped portions 611B, 612B may be provided (see imaginary lines in FIG. 19) in the third exemplary embodiment.

Tab 3

The tab 3 has the C-shaped outer edge 31 at a first end of the elongated member 2C. The outer edge 31, whose opening faces the second end of the elongated member 2C, is defined by the cutting line 30 penetrating through the belt-shaped base 601, the tearing guide piece 21, the belt-shaped body 702, and the first face portion 11A. The cutting area 32 is provided adjacent to a part of the belt-shaped base 601 adjacent to both ends of the cutting line 30 near the second end of the elongated member 2C.

Cut Portion 33

Figure 21:
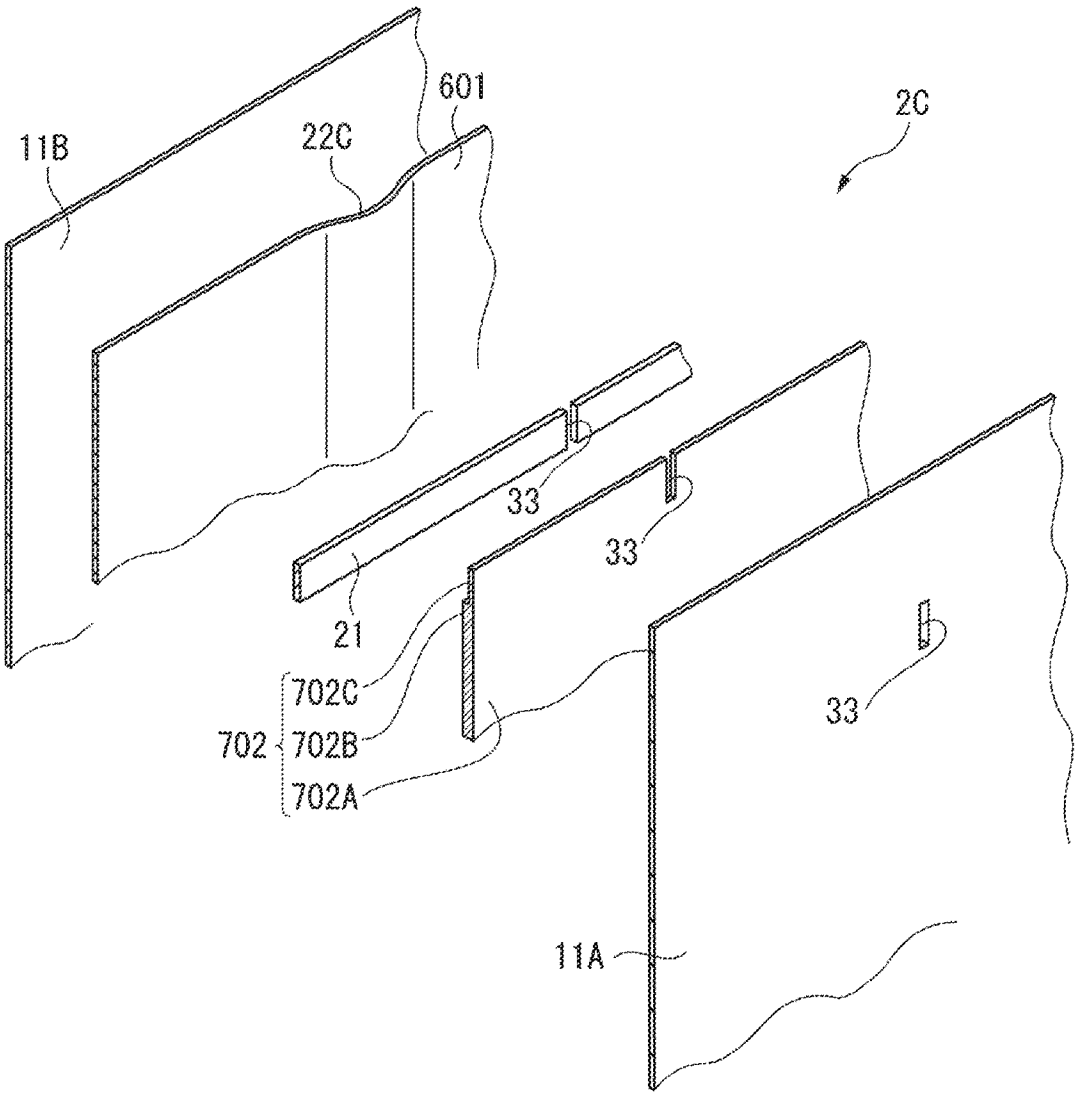
FIG. 21 is an exploded perspective view showing a vicinity of a cut portion of the bag.

A second end of the elongated member 2B in the longitudinal direction is shown in FIG. 21.

As shown in FIG. 21, the cut portion 33 is formed at the second end of the elongated member 2C.

The cut portion 33 penetrates through the first face portion 11A, the belt-shaped body 702, and the tearing guide piece 21 and extends to traverse the tearing guide piece 21 in the width direction. It should be noted that the cut portion 33 is not formed in the belt-shaped base 601.

The machine and method for manufacturing the bag 1C according to the third exemplary embodiment are the same as those in the first exemplary embodiment. The third exemplary embodiment offers the same advantages as those of the first exemplary embodiment.

Fourth Exemplary Embodiment

Next, a fourth exemplary embodiment of the invention will be described with reference to FIG. 22.

The fourth exemplary embodiment is the same as the first exemplary embodiment except for the structure of the bag body.

Figure 22:
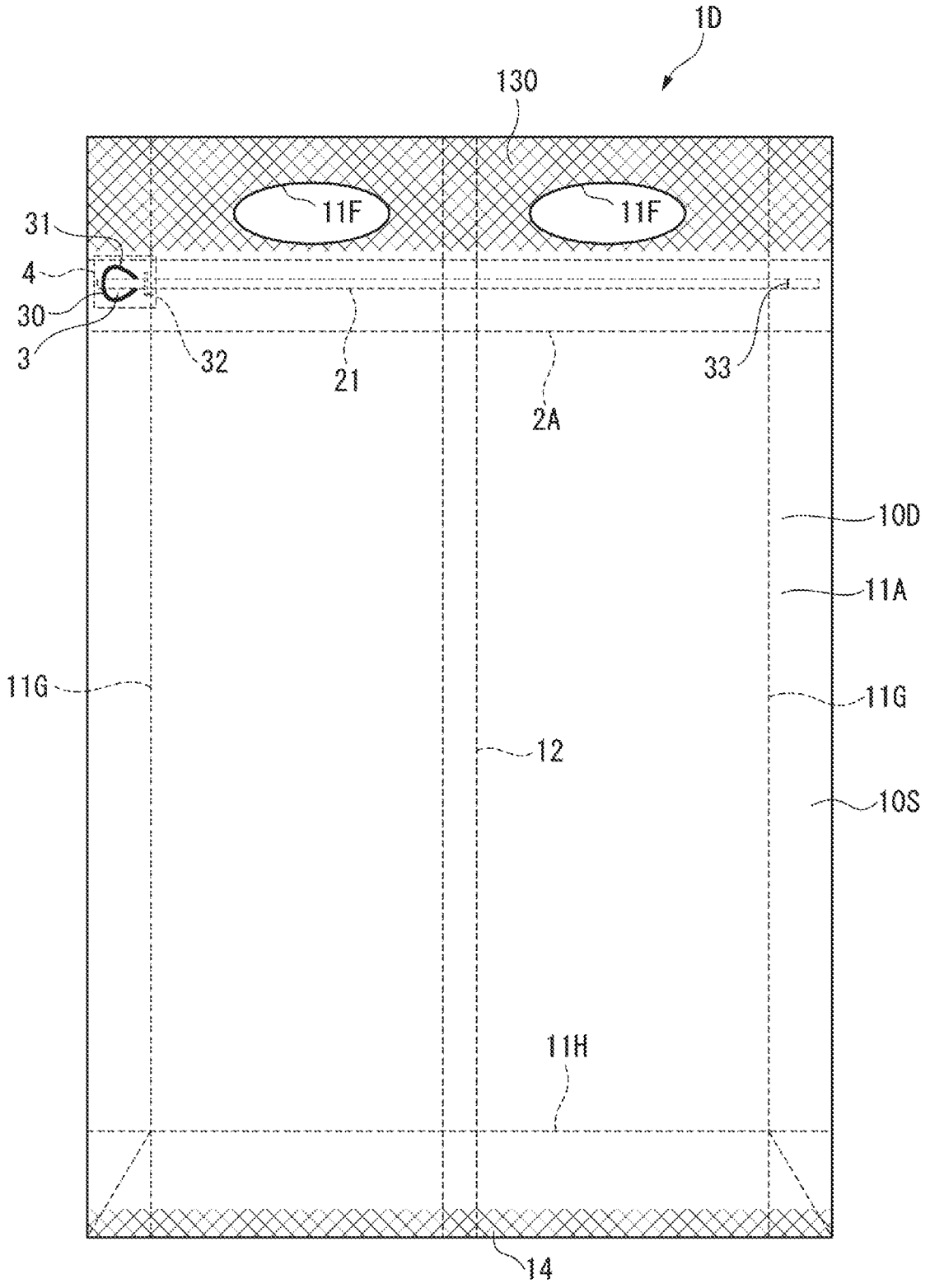
FIG. 22 is a front elevational view showing a bag according to a fourth exemplary embodiment of the invention.

As shown in FIG. 22, the bag 1D includes a bag body 10D, the elongated member 2A provided on the bag body 10D, the tab 3, and the protector 4.

The bag body 10D, which is generally called as a gusset bag, includes the pair of facing face portions 11A, 11B, a pair of lateral face portions 11G that are provided at side edges of the pair of face portions 11A, 11B and are opposed across the pair of face portions 11A, 11B, and a bottom face portion 11H. The lateral face portions 11G and the bottom face portion 11H are each interfolded along a bend line. The bag body 10D includes the top portion 130 having the grip 11F.

In the fourth exemplary embodiment, the pair of face portions 11A, 11B and the pair of lateral face portions 11G may be made of a single film while the bottom face portion 11H is made of another single film. Alternatively, the first face portion 11A, the second face portion 11B, one of the lateral face portions 11G, and the other of the lateral face portions 11G may be each made of a single film, and the bottom face portion 11H may be made of another single film.

The machine and method for manufacturing the bag 1D according to the fourth exemplary embodiment are the same as those in the first exemplary embodiment. The fourth exemplary embodiment offers the same advantages as those of the first exemplary embodiment.

Fifth Exemplary Embodiment

Next, a fifth exemplary embodiment of the invention will be described with reference to FIGS. 23 to 27.

The fifth exemplary embodiment is the same as the first exemplary embodiment except for the structure of the elongated member.

Figure 23:
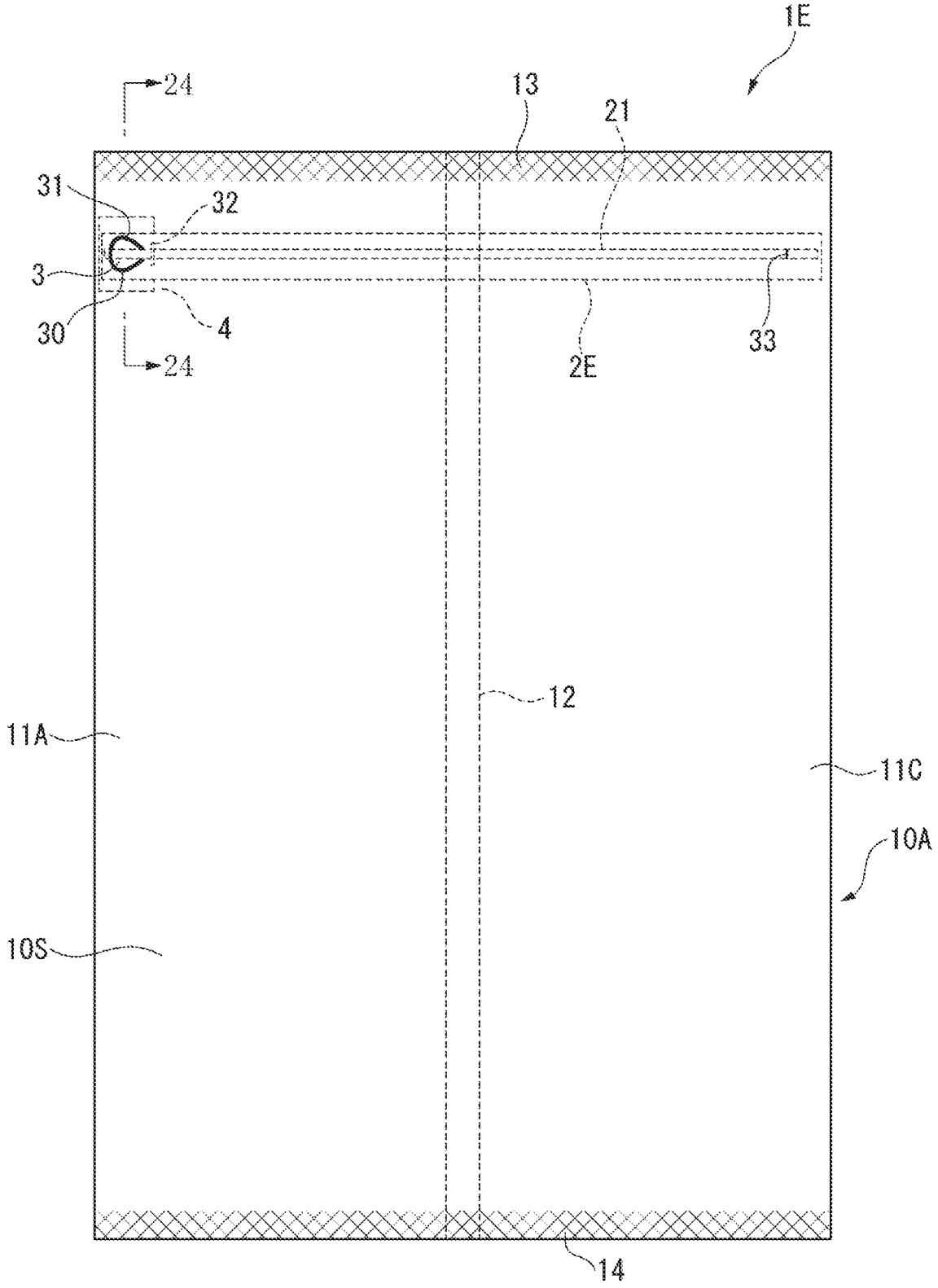
FIG. 23 is a front elevational view showing a bag according to a fifth exemplary embodiment of the invention.

FIG. 23 shows an overall arrangement of the bag 1E.

As shown in FIG. 23, the bag 1E includes the bag body 10A, an elongated member 2E provided on the bag body 10A, the tab 3, and the protector 4.

Elongated Member 2E

Specific structure of the elongated member 2E is shown in FIGS. 24 to 27.

Figure 24:
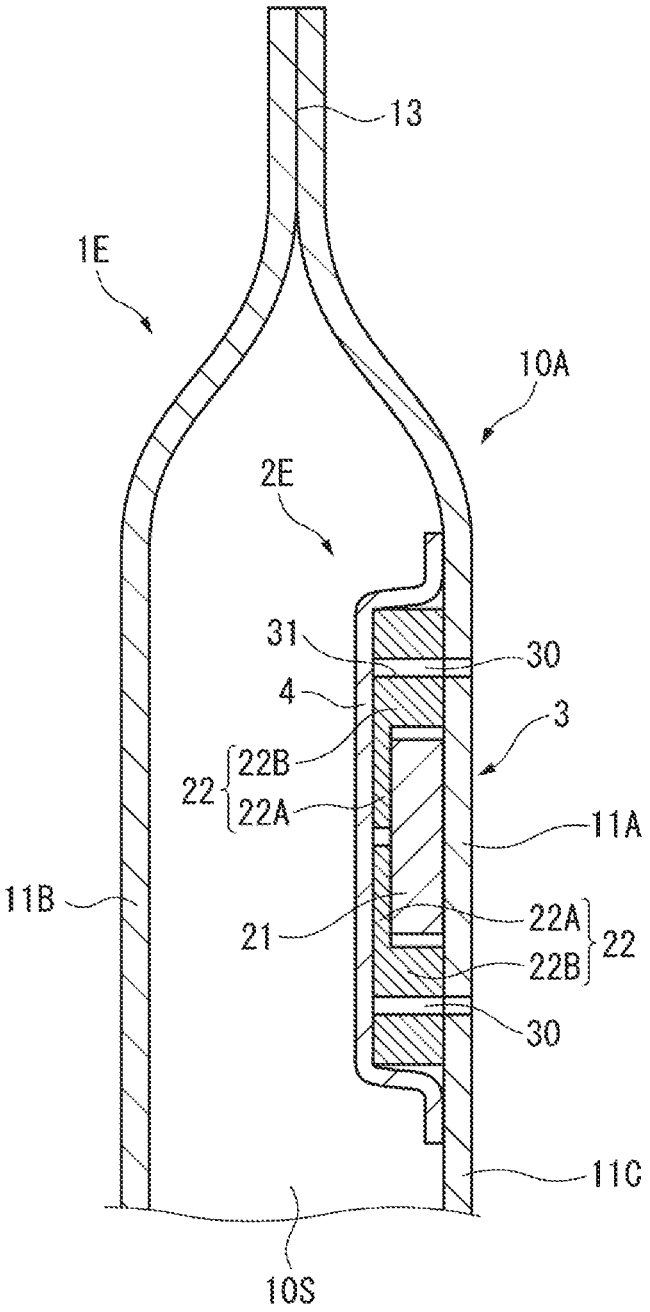
FIG. 24 is a cross-sectional view taken along 24-24 line in FIG. 23.
Figure 25:
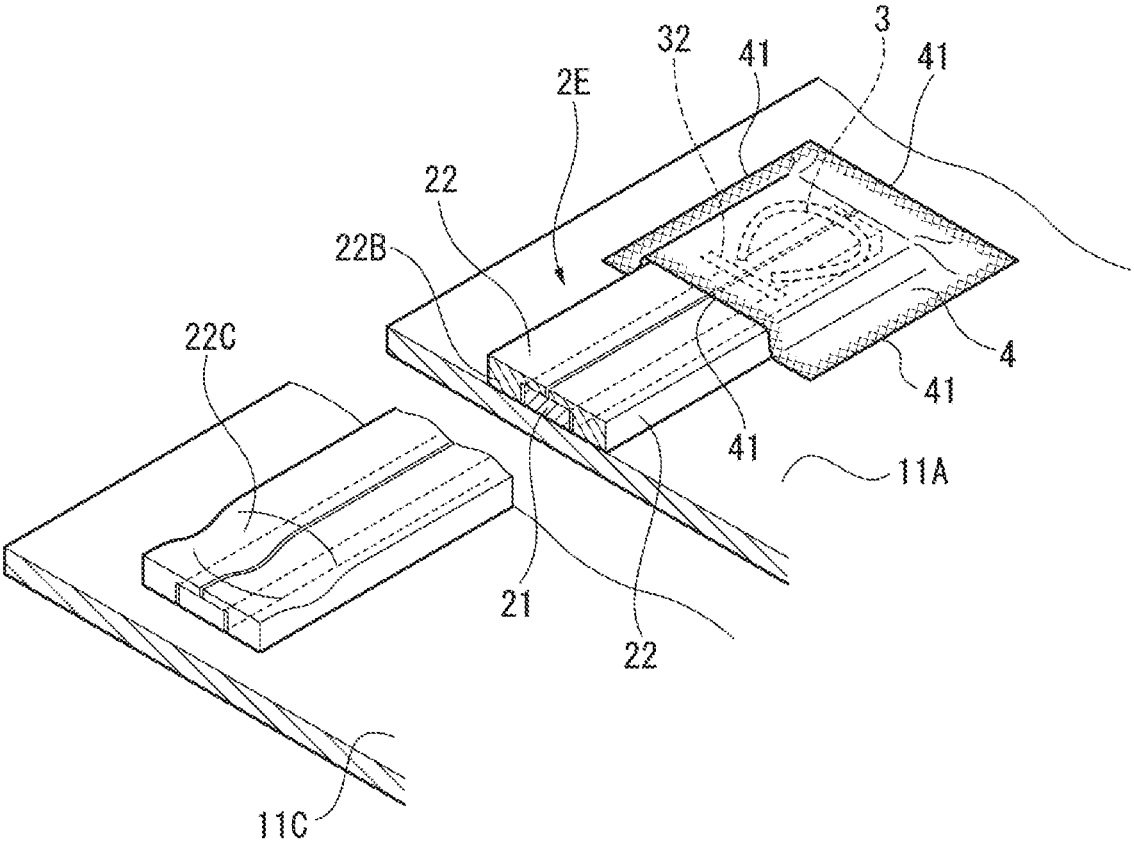
FIG. 25 is a perspective view showing a relevant part of an elongated member.

FIGS. 24 and 25 each show an entirety of the elongated member 2E.

As shown in FIGS. 24 and 25, the elongated member 2E includes the tearing guide piece 21 directly bonded to the first face portion 11A and a plurality of (two in the figures) belt-shaped bases 22 juxtaposed in the longitudinal direction of the tearing guide piece 21.

The belt-shaped base 22 is made of the same material as the zipper tape 6. It should be noted that the two belt-shaped bases 22 may be made of a flexible synthetic resin, which facilitates insertion of a hand into the interior of the bag body 10A through the gap created between the two belt-shaped bases 22.

The belt-shaped bases 22 each include a plate portion 22A disposed opposite the first face portion 11A across the tearing guide piece 21, and a projecting portion 22B integrated with the plate portion 22A. The projecting portion 22B is bonded to the first face portion 11A.

The belt-shaped bases 22 are adjacently disposed so that the plate portions 22A are close to each other and the projecting portions 22B are remote from each other.

Tab 3

Figure 26:
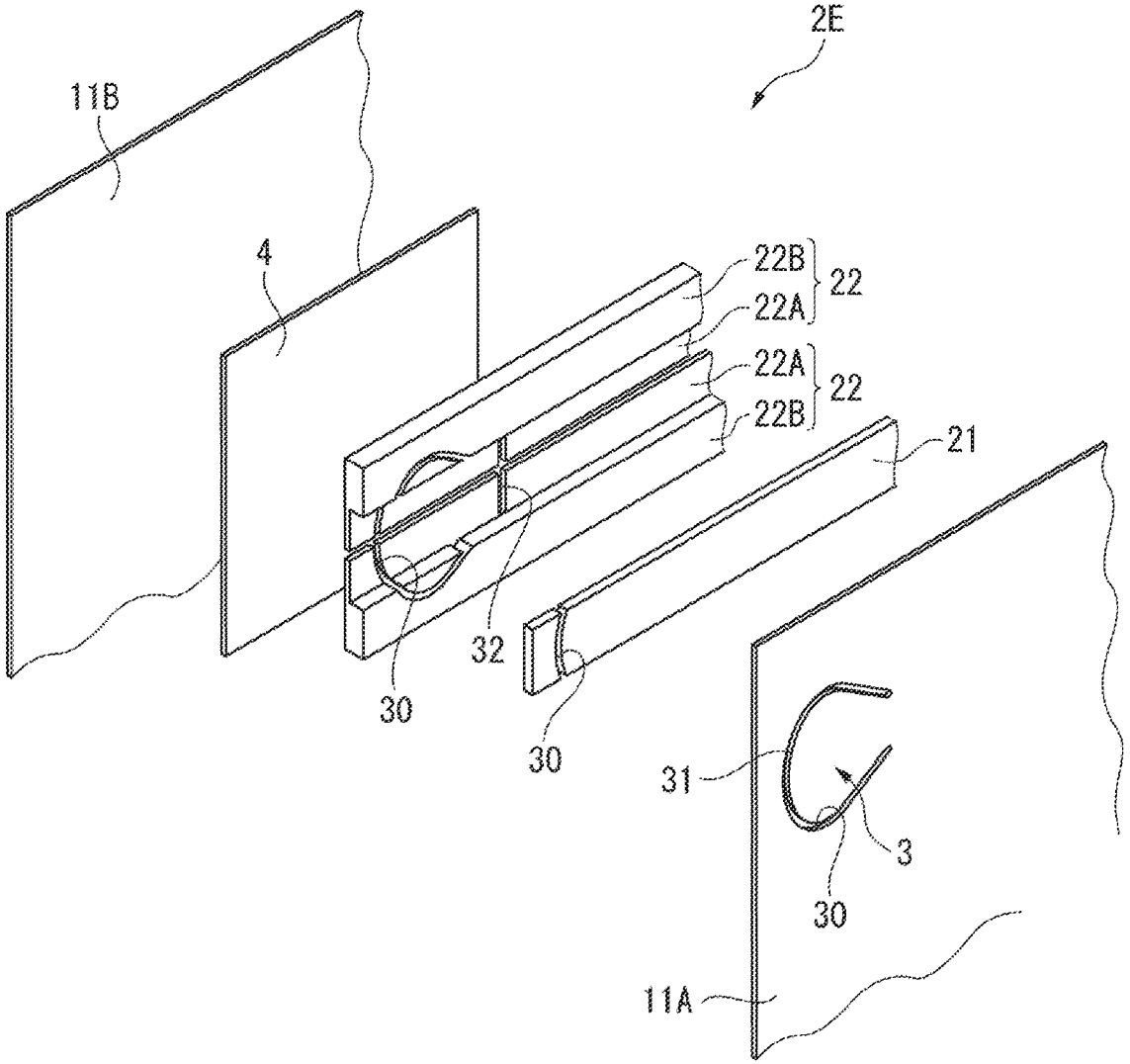
FIG. 26 is an exploded perspective view showing a vicinity of a tab of the bag.

A first end of the elongated member 2E is shown in FIG. 26.

As shown in FIGS. 24 and 26, the tab 3 includes the outer edge 31 defined by the cutting line 30 penetrating through the first end of the belt-shaped base 22 and the tearing guide piece 21 in the longitudinal direction and the first face portion 11A. In other words, the tab 3 is defined by the belt-shaped base 22, the tearing guide piece 21 and the first face portion 11A in the region defined by the outer edge 31.

The cutting area 32 for cutting the belt-shaped base 22 is provided adjacent to both ends of the cutting line 30, the cutting area 32 intersecting the tearing guide piece 21 in a width direction.

The cutting area 32 is disposed closer to the second end of the belt-shaped base 22 with respect to the cutting line 30.

Protector 4

The protector 4 is bonded to the first face portion 11A and the belt-shaped base 22. The bonding structure of the protector 4 to the first face portion 11A and the belt-shaped base 22 are not particularly limited as long as the protector 4 is capable of covering the tab 3 to keep the housing space 10S of the bag 1A from being in communication with an exterior space of the bag 1A through the cutting line 30. For instance, as shown in FIG. 25, a periphery 41 of the protector 4 may be bonded to the first face portion 11A and the belt-shaped base 22 to cover the tab 3. However, the surface of the protector 4 facing the first face portion 11A and the belt-shaped base 22 is not entirely bonded to the first face portion 11A and the belt-shaped base 22. For instance, an outer peripheral end of the part of the protector 4 covering the tab 3 is bonded to the first face portion to keep the housing space 10S of the bag 1A from being in communication with the exterior space of the bag through the cutting line 30 in the exemplary embodiment shown in FIG. 25.

The protector 4 is suitably bonded to the first face portion 11A and the belt-shaped base 22 through a known process using heat-sealing, ultrasonic sealing, adhesive, or the like.

Cut Portion 33

As shown in FIG. 23, the cut portion 33 is formed at a position different from the tearing guide piece 21 and the tab 3 of the first face portion 11A (e.g. at the second end of the elongated member 2E in the longitudinal direction).

Figure 27:
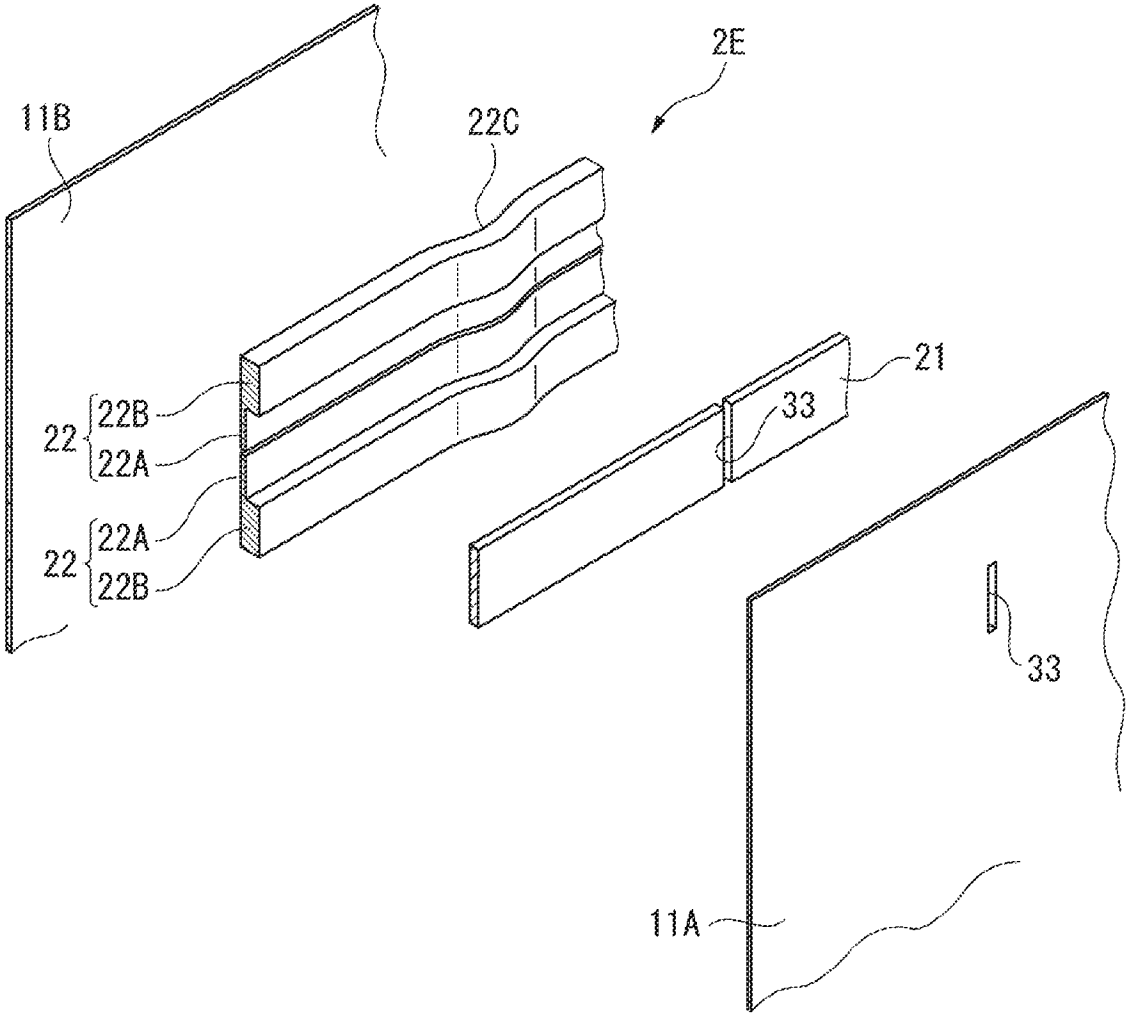
FIG. 27 is an exploded perspective view showing a vicinity of a cut portion of the bag.

A specific structure of the cut portion 333 is shown in FIG. 27.

As shown in FIG. 27, the cut portion 33 cuts through the first face portion 11A and the tearing guide piece 21 and extends to traverse the tearing guide piece 21 in the width direction. It should be noted that the cut portion 33 is not formed in the belt-shaped base 22.

In order to seal the cut portion 33, pressure may be applied to the belt-shaped base 22 from an inside and outside of the first face portion 11A. For instance, the belt-shaped bases 22 may be pressed to be squashed toward the first face portion 11A. The gap between the two belt-shaped bases 22 is closed by pressing and squashing the two belt-shaped base 22 toward the first face portion 11A. Accordingly, the interior of the bag body 10A is not in communication with the exterior through the cut portion 33. It should be noted that the gap between the belt-shaped base 22 may be closed in advance by a film or the like (not shown) as necessary.

Unsealing of Bag 1E

According to the above-described bag 1E, when the tab 3 is pulled in a direction away from the second face portion 11B after the contents are housed in the housing space, the tearing guide piece 21, which is separated from the two belt-shaped bases 22, rips the first face portion 11A, unsealing the bag 1A along the longitudinal direction of the tearing guide piece 21.

After the bag is unsealed, a gap is created between the adjoining belt-shaped bases 22, through which a hand can be inserted, thus easily taking out the contents O housed in the bag body 10A.

The film assembly, manufacturing method and manufacturing machine of the bag according to the fifth exemplary embodiment are the same as those in the first exemplary embodiment. The fifth exemplary embodiment offers the same advantages as those in the first exemplary embodiment.

Modifications

It should be noted that the scope of the invention is not limited to the above-described exemplary embodiments, but encompasses modifications and improvements as long as the modifications and improvements are compatible with an object of the invention.

Figure 28:
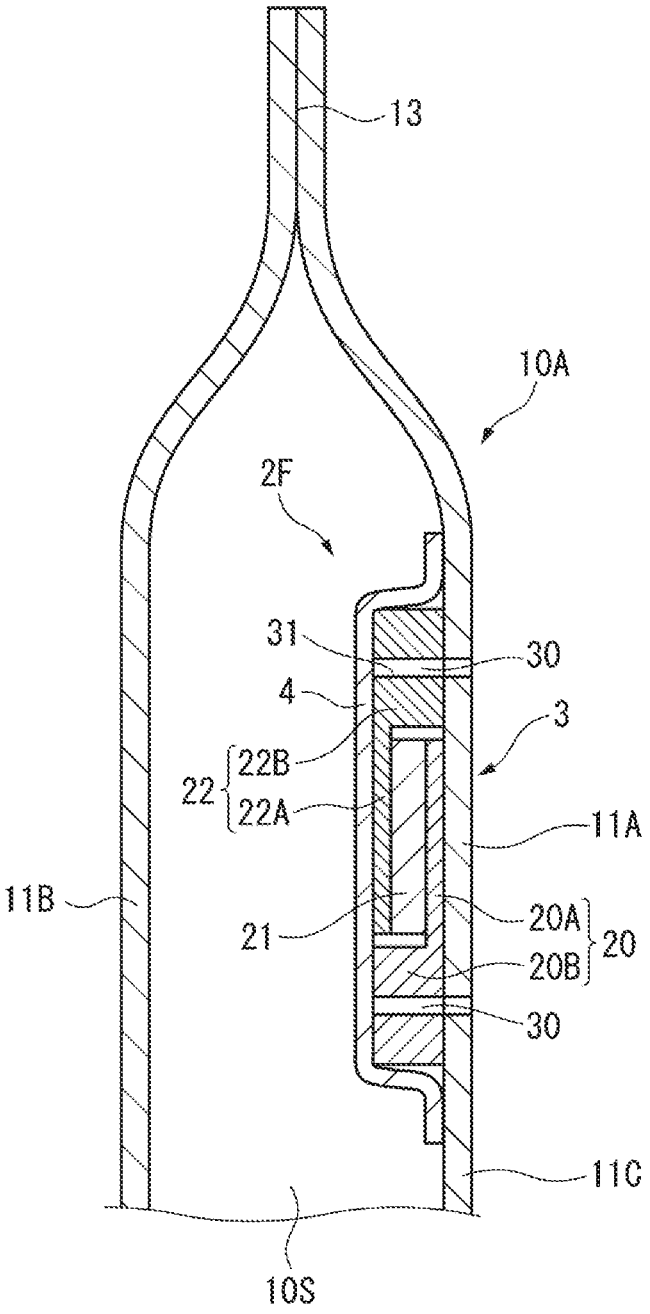
FIG. 28, which corresponds to FIG. 24, is an illustration showing a relevant part of a bag according to a modification of the invention.
Figure 29:
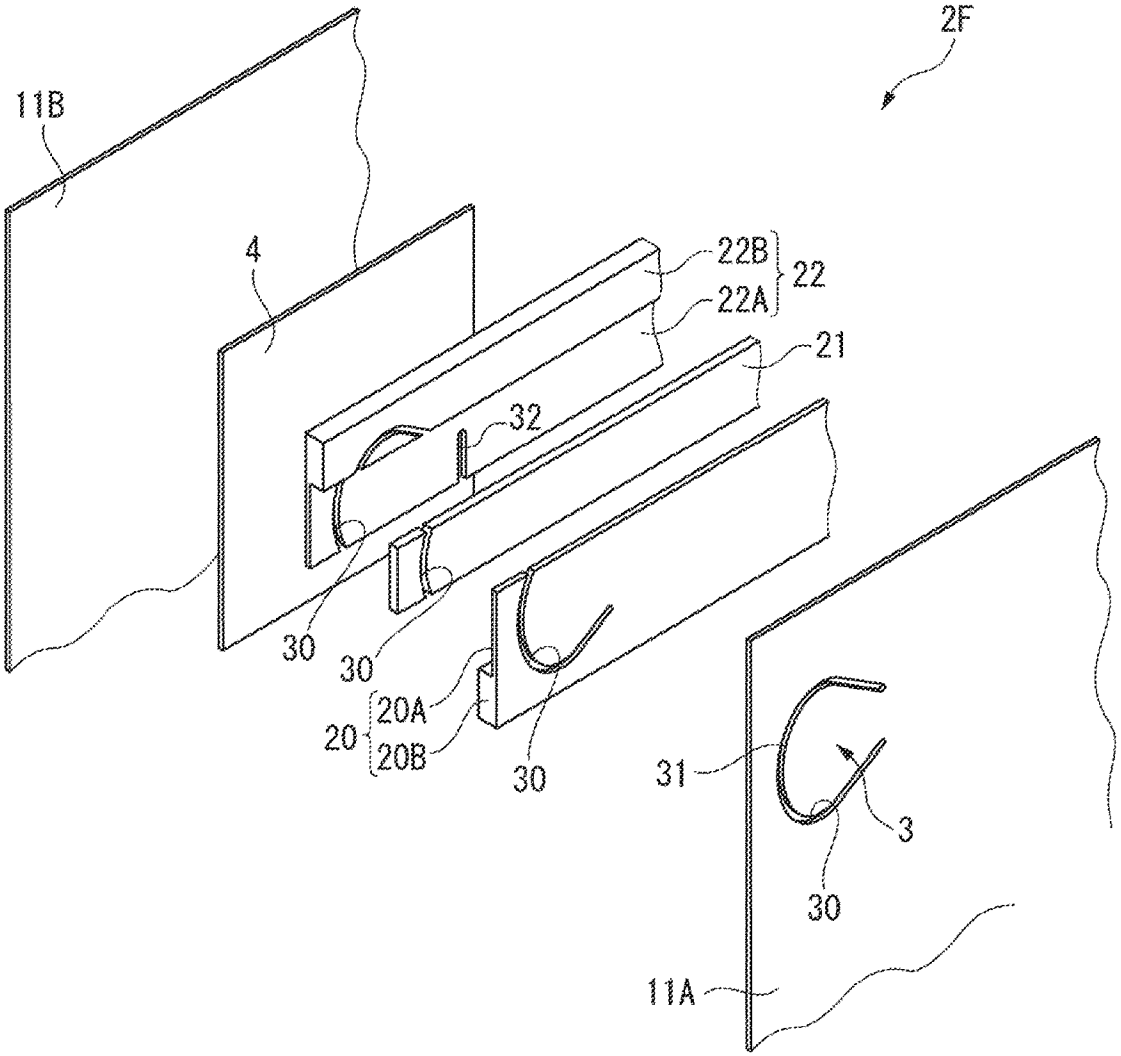
FIG. 29 is an exploded perspective view showing a vicinity of a tab of the bag.

For instance, two belt-shaped bases 22 are prepared and the tearing guide piece 21 is directly bonded to the first face portion 11A to form the elongated member 2E in the fifth exemplary embodiment. However, as shown in FIGS. 28 and 29, the elongated member 2F includes a belt-shaped sheet 20 bonded to the first face portion 11A, the tearing guide piece 21 provided on the belt-shaped sheet 20, and the belt-shaped base 22 disposed along the longitudinal direction of the tearing guide piece 21 in some embodiments of the invention. In other words, the tearing guide piece 21 is indirectly provided to the first face portion 11A through the belt-shaped sheet 20.

Figure 30:
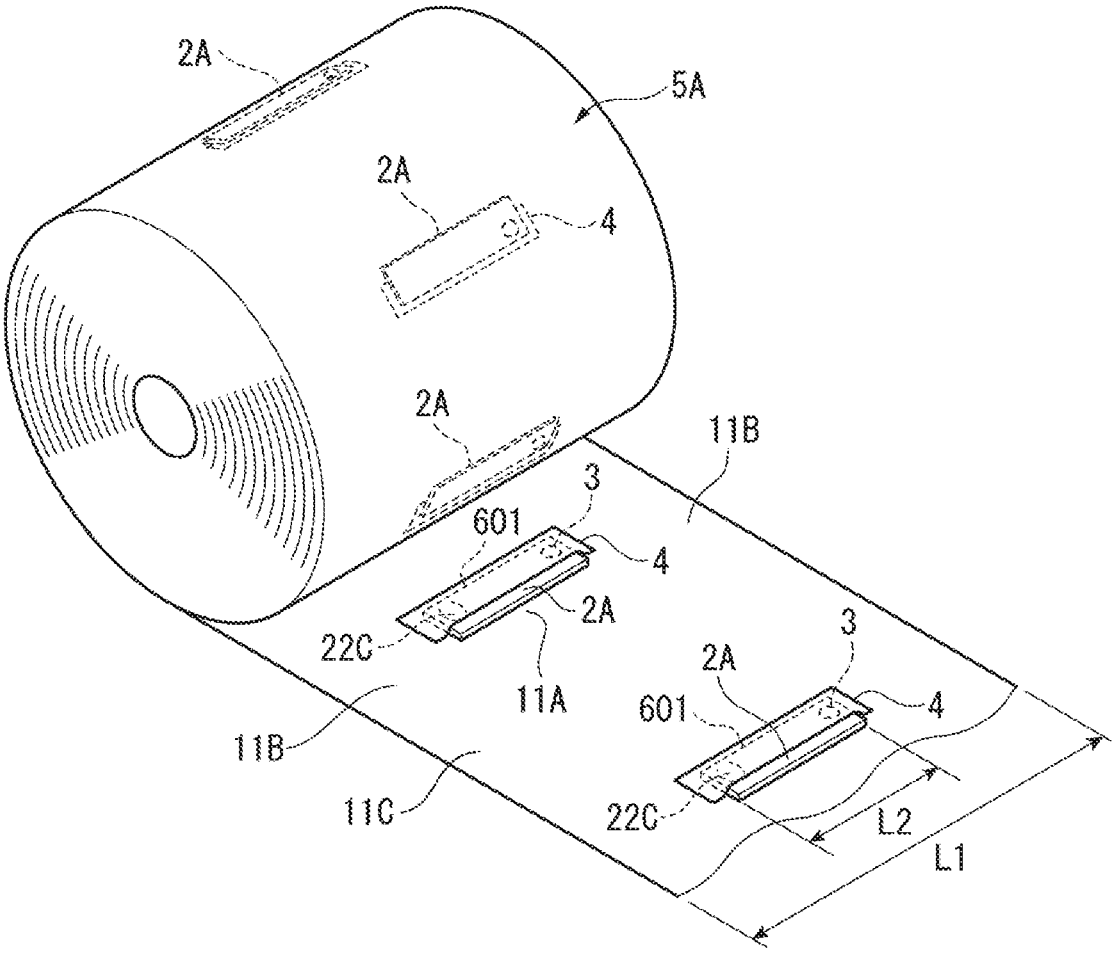
FIG. 30, which corresponds to FIG. 6, is an illustration showing a film assembly according to another modification of the invention.

The protector 4, which is provided only at a part covering the tab 3 in the above-described exemplary embodiments, runs the entire length of the belt-shaped bases 22, 601 along the longitudinal direction of the belt-shaped bases 22, 601 in some embodiments of the invention. For instance, as shown in FIG. 30, the protector 4, which is in a form of an elongated component, is provided on the belt-shaped base 601 to extend from the first end to the second end of the elongated member 2A in the longitudinal direction in some embodiments.

Though the film assemblies 5A, 5B are each wound into a roll in the above exemplary embodiments, the film assemblies 5A, 5B are folded in some embodiments of the invention.

Further, though the bag bodies 10A, 10B each have the bonding portion 12 provided by overlapping the mutually opposite peripheral ends of the single film 11C, the bag bodies 10A, 10B have the bonding portion 12 provided by folding edges of the single film 11C at positions remote from the edges by the same dimension, and bonding the overlapped periphery of the two-folded edges in some embodiments of the invention.

The invention claimed is:

1. A bag comprising:

a bag body made of at least one folded or overlapped film, the bag body comprising a plurality of face portions at least comprising mutually facing first face portion and second face portion, the face portions defining a housing space;

an elongated member provided on the first face portion, the elongated member comprising an elongated tearing guide piece and a zipper tape, the zipper tape comprising a first member comprising a belt-shaped base and a first engagement portion continuous with the belt-shaped base and a second member comprising a belt-shaped body and a second engagement portion continuous with the belt-shaped body and engageable with the first engagement portion; and a tab comprising an outer edge defined by a cutting line penetrating through the belt-shaped base and the first face portion, the tab allowing the tearing guide piece to be pinched, wherein the belt-shaped base is extended in a width direction to protrude beyond a first end of the belt-shaped body in the width direction when the first engagement portion and the second engagement portion are engaged, an extended part of the belt-shaped base and the belt-shaped body are bonded to the first face portion with a surface provided with the first engagement portion and a surface not provided with the second engagement portion, respectively, the belt-shaped base is interposed between the second face portion and the tearing guide piece, a protector covering the tab is provided on a surface of the first face portion provided with the belt-shaped base and a surface of the belt-shaped base opposite from the tearing guide piece, and wherein an outer periphery of the protector is bonded to at least the belt-shaped base by a first bonding portion isolated from a second bonding portion of the bag body in which the first face portion and the second face portion are bonded with each other.

2. The bag according to claim 1, wherein the belt-shaped base and the tearing guide piece are integrated.

3. The bag according to claim 1, wherein the bag body is made of a single film, the bag body being provided with a bonding portion formed by overlapping edges of the film located opposite with each other.

4. The bag according to claim 1, wherein the plurality of face portions further comprise a bottom face portion bonded with the first and the second face portions at peripheral ends thereof.

5. The bag according to claim 4, wherein the plurality of face portions comprise a pair of lateral face portions provided at side edges of the first and second face portions and facing each other through the first and second face portions, and the bottom face portion, and the lateral face portions are each interfolded along a bend line.

6. The bag according to claim 1, wherein a grip is provided in the bag body.

7. The bag according to claim 1, wherein a cutting area configured to cut the belt-shaped base in a manner intersecting a width direction of the tearing guide piece is provided adjacent to both ends of the cutting line.

8. A bag comprising:

a bag body made of at least one folded or overlapped film, the bag body comprising a plurality of face portions at least comprising mutually facing first face portion and second face portion, the face portions defining a housing space;

an elongated member provided on the first face portion, the elongated member comprising an elongated tearing guide piece and a zipper tape, the zipper tape comprising a first member comprising a belt-shaped base and a first engagement portion continuous with the belt-shaped base and a second member comprising a belt-shaped body and a second engagement portion continuous with the belt-shaped body and engageable with the first engagement portion;

a tab comprising an outer edge defined by a cutting line penetrating through the belt-shaped base and the first face portion, the tab allowing the tearing guide piece to be pinched; and a cut portion formed at a position different from the tab in the tearing guide piece and the first face portion, the cut portion being configured to cut the first face portion and the tearing guide piece in a manner intersecting the width direction of the tearing guide piece, wherein the belt-shaped base is extended in a width direction to protrude beyond a first end of the belt-shaped body in the width direction when the first engagement portion and the second engagement portion are engaged, an extended part of the belt-shaped base and the belt-shaped body are bonded to the first face portion with a surface provided with the first engagement portion and a surface not provided with the second engagement portion, respectively, the belt-shaped base is interposed between the second face portion and the tearing guide piece, a protector covering the tab is provided on a surface of the first face portion provided with the belt-shaped base and a surface of the belt-shaped base opposite from the tearing guide piece.

9. A film assembly comprising:

a film;

a plurality of elongated members provided on one surface of the film in a manner mutually spaced apart in a longitudinal direction of the film; and a tab, wherein the elongated members each comprise: an elongated tearing guide piece; and a zipper tape, the zipper tape comprises: a first member comprising a belt-shaped base and a first engagement portion continuous with the belt-shaped base; and a second member comprising a belt-shaped body and a second engagement portion continuous with the belt-shaped body and engageable with the first engagement portion, the belt-shaped base is extended in a width direction to protrude beyond a first end of the belt-shaped body in the width direction when the first engagement portion and the second engagement portion are engaged, the extended part of the belt-shaped base and the belt-shaped body are bonded to the film with a surface provided with the first engagement portion and a surface not provided with the second engagement portion, respectively, the belt-shaped base is provided on a surface of the tearing guide piece opposite a surface of the tearing guide piece facing the film, the tab comprises an outer edge defined by a cutting line penetrating through the belt-shaped base and the film, the tab allowing the tearing guide piece to be pinched, a protector covering the tab is provided on a side of the film provided with the belt-shaped base and a surface of the belt-shaped base opposite from the tearing guide piece, and a length of the film in a width direction is more than twice as large as a length of each of the elongated members in a longitudinal direction.

10. The film assembly according to claim 9, further comprising:

a cut portion formed at a position different from the tab in the tearing guide piece and the film, the cut portion being configured to cut the film and the tearing guide piece in a manner intersecting the width direction of the tearing guide piece.

11. The film assembly according to claim 9, further comprising:

a plurality of additional films, one of peripheral ends of each of the additional films being bonded with the film in parallel to the elongated members.

12. A manufacturing method of a bag, the method comprising:

feeding the film assembly according to claim 9;

folding peripheral ends of the film along a feeding direction of the film toward an inner side provided with the elongated members and bonding an overlapped portion to form a linear bonding portion, thereby turning the film into a tube;

bonding a folded part and an unfolded part of the film along a transverse direction intersecting the bonding portion to form a bottom portion of the bag; and cutting the film in parallel to the bottom portion at a position opposite the part bonded along the transverse direction of the film across the elongated member.

13. The film assembly according to claim 9, wherein a cutting area configured to cut the belt-shaped base in a manner intersecting a width direction of the tearing guide piece is provided adjacent to both ends of the cutting line.

14. A manufacturing method of a bag, the method comprising:

feeding an elongated member on a film, the elongated member comprising an elongated zipper tape and an elongated tearing guide piece, the zipper comprising a first member comprising a belt-shaped base and a first engagement portion continuous with the belt-shaped base and a second member comprising a belt-shaped body and a second engagement portion continuous with the belt-shaped body and engageable with the first engagement portion, the belt-shaped base being extended in a width direction beyond a first end of the belt-shaped body in the width direction when the first engagement portion and the second engagement portion are engaged, the tearing guide piece being provided on a surface of the belt-shaped base provided with the first engagement portion along a longitudinal direction of the belt-shaped base, the film having a length in a width direction that is more than twice as large as a length of the elongated member in the longitudinal direction, the elongated member being fed in the longitudinal direction so that the tearing guide piece faces the film and the belt-shaped base faces opposite the film;

providing a cutting line penetrating through the belt-shaped base and the film to form an outer edge of a tab that allows the tearing guide piece to be pinched;

bonding a protector covering the tab on the surface of the film and a surface of the belt-shaped base opposite from the tearing guide piece;

folding peripheral ends of the film toward an inner side provided with the elongated member and bonding an overlapped portion to form a linear bonding portion, thereby turning the film into a tubular film;

bonding a folded part and an unfolded part of the film along a transverse direction intersecting the bonding portion to form a bottom portion of the bag;

packing contents in an inside of the tubular film;

after the contents are packed in the inside of the film, bonding a folded part and an unfolded part of the film at a position remote from the bottom portion along the bonding portion to form a top portion of the bag; and cutting the film at the top portion of the bag or a part of the top portion located opposite a side of the top portion packed with the contents.

15. The manufacturing method of a bag according to claim 14, further comprising:

cutting the film and the tearing guide piece in a manner intersecting the width direction of the tearing guide piece to form a cut portion in the tearing guide piece and the film each at a position different from the tab.

16. The manufacturing method of a bag according to claim 14, further comprising:

providing a cutting area configured to cut the belt-shaped base in a manner intersecting a width direction of the tearing guide piece at a position adjacent to both ends of the cutting line.

* * * * *